US009174095B2

(12) United States Patent
Goebel et al.

(10) Patent No.: US 9,174,095 B2
(45) Date of Patent: Nov. 3, 2015

(54) METHOD AND APPARATUS FOR TRAINING A GOLF SWING

(71) Applicants: George A. Goebel, Montclair, NJ (US); Norman Barrigas, Bronxville, NY (US); Paul Dowd, Bronxville, NY (US); Erol Searfoss, Bronxivlle, NY (US)

(72) Inventors: George A. Goebel, Montclair, NJ (US); Norman Barrigas, Bronxville, NY (US); Paul Dowd, Bronxville, NY (US); Erol Searfoss, Bronxivlle, NY (US)

( * ) Notice: Subject to any disclaimer, the term of this patent is extended or adjusted under 35 U.S.C. 154(b) by 0 days.

(21) Appl. No.: 14/281,327

(22) Filed: May 19, 2014

(65) Prior Publication Data

US 2015/0018109 A1 Jan. 15, 2015

Related U.S. Application Data

(60) Provisional application No. 61/825,320, filed on May 20, 2013.

(51) Int. Cl.

| | |
|---|---|
| ***A63B 69/36*** | (2006.01) |
| ***A63B 47/00*** | (2006.01) |
| *A63B 57/00* | (2015.01) |
| *A63B 71/06* | (2006.01) |

(52) U.S. Cl.

CPC ..... *A63B 47/002* (2013.01); *A63B 57/0006* (2013.01); *A63B 69/3661* (2013.01); *A63B 2071/0625* (2013.01); *A63B 2208/12* (2013.01); *A63B 2220/801* (2013.01); *A63B 2220/805* (2013.01); *A63B 2220/808* (2013.01); *A63B 2225/09* (2013.01)

(58) Field of Classification Search

CPC .. A63B 57/00; A63B 47/002; A63B 57/0006; A63B 222/805; A63B 2208/12; A63B 2220/801; A63B 2220/808; A63B 2225/09; A63B 2071/0625

See application file for complete search history.

(56) References Cited

U.S. PATENT DOCUMENTS

| | | | | | |
|---|---|---|---|---|---|
| 2,152,680 | A | * | 4/1939 | Blaski | 473/136 |
| 3,738,662 | A | * | 6/1973 | Hodgin | 473/133 |
| 3,895,366 | A | * | 7/1975 | Morris | 340/870.26 |
| 4,146,232 | A | * | 3/1979 | Stone | 473/137 |
| 4,181,309 | A | * | 1/1980 | Atkinson et al. | 473/136 |
| 4,662,641 | A | | 5/1987 | Peyret, Jr. | |
| 5,052,688 | A | * | 10/1991 | Shiau | 473/135 |
| 5,464,223 | A | * | 11/1995 | Dermott | 473/134 |
| 5,549,517 | A | * | 8/1996 | Ikemoto | 473/134 |
| 5,582,325 | A | * | 12/1996 | Janier | 473/137 |
| 5,643,096 | A | * | 7/1997 | Lowe | 473/135 |
| 6,045,364 | A | | 4/2000 | Dugan et al. | |
| 6,106,407 | A | * | 8/2000 | Peyton, Jr. | 473/225 |
| 7,160,200 | B2 | | 1/2007 | Grober | |
| 8,109,816 | B1 | | 2/2012 | Grober | |

(Continued)

*Primary Examiner* — Steven Wong
(74) *Attorney, Agent, or Firm* — Graham Curtin

(57) ABSTRACT

Apparatus and methods for using a plurality of golf balls to train a person to swing a golf club are described. In accordance with one aspect of the present invention, the apparatus includes a ramp, a golf ball holder and a trigger, which may be mechanical or electrical. The ramp conveys the plurality of golf balls, one at a time, from a first end of the ramp to a second end of the ramp. At least a portion of the ramp is angled downward from the first end to the second end. The holder contains the plurality of golf balls. It is arranged near the first end of the ramp to release one of the plurality of golf balls at a time onto the ramp. The holder further has an input. The trigger is connected to the input of the holder and arranged so that it can sense the golf swing, wherein when the trigger senses the golf swing, it triggers the input of the holder to cause the holder to release one of the plurality of golf balls into the ramp.

20 Claims, 30 Drawing Sheets

(56) References Cited

U.S. PATENT DOCUMENTS

| | | | | |
|---|---|---|---|---|
| 8,753,217 | B2 * | 6/2014 | Seong | 473/133 |
| 2007/0082325 | A1 | 4/2007 | Novosel, Sr. | |
| 2007/0111811 | A1 | 5/2007 | Grober | |
| 2011/0143866 | A1 | 6/2011 | McConnell | |
| 2011/0306435 | A1 * | 12/2011 | Seo | 473/221 |

* cited by examiner

METHOD AND APPARATUS FOR TRAINING A GOLF SWING

CROSS REFERENCES TO RELATED APPLICATIONS

The present application claims priority to and the benefit of U.S. Provisional Patent Application Ser. No. 61/825,320 filed on May 20, 2013, which is incorporated herein by reference in its entirety.

BACKGROUND OF THE INVENTION

The present invention relates to golf and to methods and apparatus for training a person to swing a golf club. More specifically, this invention relates generally to golf practice devices and methods to train a golfer's rhythm, timing and tempo; to develop a golfer's automatic processing of motor skills; to promote a golfer's proper swing path; and to exercise a golfer's visuomotor system.

According to Yale University Physicist, Dr. Robert D. Grober, in his study "Towards a Biomechanical Understanding of Tempo in the Golf Swing," professional golfers have, at the core of their golf swing, a biometrical clock. This clock, and the resulting tempo, is defined by the rotational inertia of the body/club system and the elastic properties of the body; yielding a system which can be modeled as a simple harmonic oscillator. The presence of this system in a golfer is considered to be, by some, one of the most important fundamentals of a great golf swing.

There are many technical aspects of the golf swing that need to be practiced, but they tend to be practiced slowly, which develops poor tempo. Accordingly, training devices that develop appropriate tempo are required.

Training aids that help develop tempo or rhythm are available. These training aids simply offer the golfer auditory cues as boundaries for the timing of a golf swing. These audio cues can not only be distracting, but can also permit the golfer to "conveniently" alter the lines of these boundaries to be within his comfort level. Also some of these audio cues have built in "human-reaction times" that are not accurate for all individuals.

Other golf swing training aids on the market are designed to physically manipulate and/or restrict the human body. Still, many other golf swing training aids are immobile physical boundaries in space, intended to direct the club for the golfer. The artificial movements created by many of these devices tend to be difficult or awkward to replicate once the devices are removed.

In view of the limitations of existing golf training devices, new and improved golf training apparatus and methods are needed.

SUMMARY OF THE INVENTION

Apparatus and methods for using a plurality of golf balls to train a person to swing a golf club are described. In accordance with one aspect of the present invention, the apparatus includes a ramp, a golf ball holder and a trigger, which may be mechanical or electrical. The ramp conveys the plurality of golf balls, one at a time, from a first end of the ramp to a second end of the ramp. At least a portion of the ramp is angled downward from the first end to the second end. The holder contains the plurality of golf balls. It is arranged near the first end of the ramp to release one of the plurality of golf balls at a time onto the ramp. The holder further has an input. The trigger is connected to the input of the holder and arranged so that it can sense the golf swing, wherein when the trigger senses the golf swing, it triggers the input of the holder to cause the holder to release one of the plurality of golf balls into the ramp.

The ramp is generally U-shaped to support the plurality of golf balls. The length of the ramp is adjustable in increments. The increments can be labeled with a timing mark.

The trigger can be a mechanical arm having one end connected to the input of the holder. The mechanical arm has a second end which is hit by the golf club during the golf swing to trigger the holder to release one of the plurality of golf balls. The mechanical arm can have an adjustable length.

The trigger can also be an optical sensor. In accordance with an aspect of the invention the optical sensor senses the golf club during the golf swing, and when the optical sensor senses the golf club, it sends an electrical signal to the input of the holder to cause one of the plurality of golf balls to be released.

In accordance with another aspect of the invention, a sound generator is connected to the trigger, wherein the sound generator generates a sound a predetermined time after the trigger is triggered. This audio tone is used to cue the golfer to begin the downswing. The predetermined time can be selectable.

In accordance with another aspect of the invention, a method of using a plurality of golf balls to train a person to swing a golf club is provided. In accordance with this aspect of the invention, the person starts a golf swing. Then, the golf swing is detected with a trigger device. The trigger device, in response to detecting the golf swing, communicates with a container that holds the plurality of golf balls. The container, in response to the trigger device communicating with the container, releases one of the plurality of golf balls onto a ramp. Then the ramp conveys the released golf ball from the container to the person. Once the golf ball is released, the person hits the golf ball.

The trigger device can be a mechanical arm or an electrical sensor, such as an optical sensor.

In accordance with another aspect of the invention, the trigger device, in response to detecting the golf swing, communicates with a sound generator to cause the sound generator to generate a sound at a predetermined time after the trigger device detects the golf swing. This sound is meant to occur when a player is at the top of their swing to help them time the swing.

In accordance with another aspect of the invention, the method includes adjusting the length of the ramp to adjust the time the release golf ball travels on the ramp. The method can also include adjusting the predetermined time.

In accordance with another aspect of the invention, the device can have adjustable legs on the rear parts of the device, as most of the device is off the ramp. Not all golf mats are the same thickness, so the unit is adjustable to accommodate varying mat thicknesses. These legs will also serve as leveling devices to be used with a bubble level attached to the device. Legs can also be provided on the front of the unit.

Another aspect of the device is an optional clamping mechanism that secures the front of the device to the mat, so the device does not shift position during use.

In accordance with an aspect of the method of the present, it is preferable that a golfer mark the precise location of the impact zone with something temporary, such as a chalk line, soapstone marker, temporary fabric marker, or laser pointer.

In accordance with a further aspect of the present invention, the ramp is designed so that golf balls roll off the ramp directly onto the map or other hitting surface. Thus, there should be little or no bounce to the ball.

Golf takes a lot of time to practice. The present device helps a golfer cut down on his or her practice time by using this device and practicing effectively.

DESCRIPTION

Figure 2:
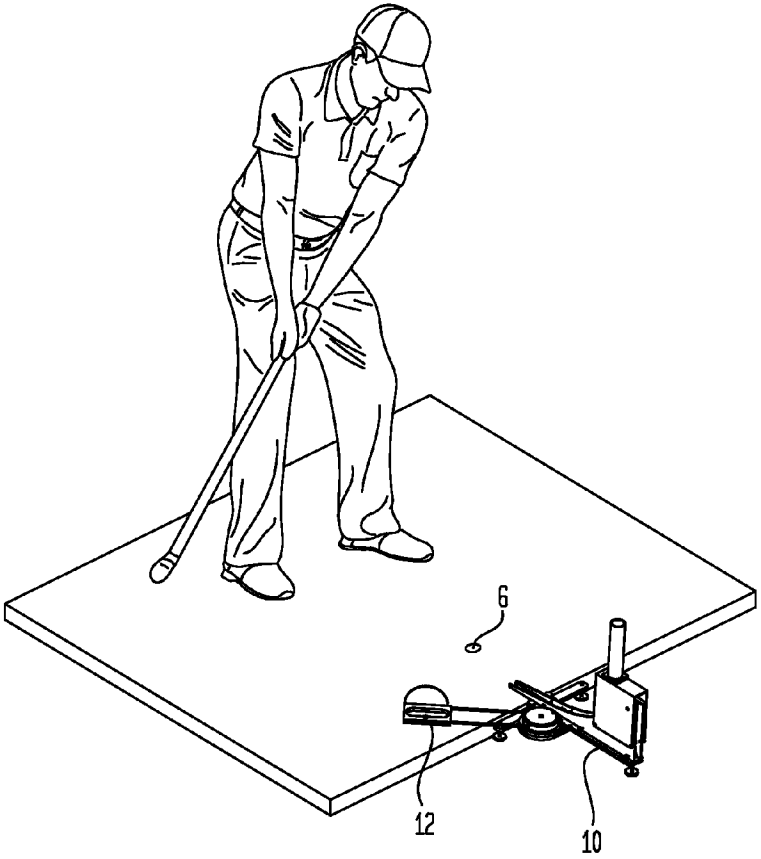
FIG. 2 illustrates a second step in accordance with an aspect of the present invention.

The apparatus and methods for training a golf swing, in accordance with various aspects of the present invention, alter the golf ball from a stationary target to a moving target. The apparatus has a golf ball holder, a triggering mechanism and a ramp. As a golfer starts a swing, the triggering mechanism senses the swing. The triggering mechanism can be any type of sensor, including, but not limited to, a mechanical arm that a golf club touches or an optical sensor that detects the absence of light as the golf club moves over the sensor. When the golf swing is sensed by the triggering mechanism, it sends a signal to the golf ball holder to release a golf ball. The signal can be generated by mechanical interaction between the triggering mechanism and the golf ball holder or it can be an electrical signal that causes the golf ball holder to release a ball. The golf ball is released onto a ramp which rolls the ball to the golfer. The time elapsed from the time the golf club triggers the triggering mechanism until the golf ball reaches the player is preferable a predetermined time that helps the golfer develop a timing and a rhythm to improve the golf swing.

By changing golf balls to moving targets, it enables the golfer to practice and exercise several aspects of a golf swing. The golfer will benefit from using the device when playing with a stationary ball. The device is intended for use by golfers of all skill levels. In accordance with an aspect of the presenting invention, the movement of a golf ball toward the player is triggered by the golfer's backswing. The ball arrives to the impact zone within specific timeframes coordinated to match those of skilled golfers.

As used herein, the word Targetline refers to an imaginary line that lies on the ground surface, running parallel to the golfers address/stance line, extending all the way to the Ultimate Target.

As used herein, the word Ultimate Target refers to the location where the golfer is attempting to hit the ball to. For example, at a practice range a golfer may be practicing with his 8 iron attempting to land the ball at the yardage indicator labeled 150 yards. On a golf course the ultimate location is where the golfer wants to land the ball. The ultimate Target is located at the end of the targetline.

As used herein the word Impact Zone refers to the location on the Targetline where the golf ball is struck and propelled by a club head of a golf club.

The training device, in accordance with an aspect of the present invention, does not impose any physically restrictive elements on the club or body. It allows the golfer to operate using his own unique physical attributes. The mind and body are able to operate freely. The golfer is able to tap into his personal natural abilities.

An important segment in the sequence of this system is the elapsed time it takes a golfer from the start of the swing to the moment of striking the ball. The sub-segments of this segment are what are known as the takeaway, the backswing, the top of the backswing, the transition, the downswing and impact. The transition through these sub-segments, but not necessarily the sub-segments themselves, in accordance various aspects of the present invention, is shown in FIGS. 1, 2, 3, 4, 5 and 6.

The total elapsed time for professional and skilled golfers to execute all of these sub-segments is between 0.85 to 1.15 seconds. Furthermore, they are able to consistently repeat this precise timing with each swing. On the contrary, many amateur golfers perform this sequence in a significantly longer 2-3 seconds, with the timing of each swing varying from shot to shot. This commonly consists of an extremely slow backswing paired with a rushed, jerky lunge at the ball. This is a big departure from the "biometrical clock" motion required to benefit from the elastic properties of the body. Additionally, this extra time is usually accompanied by conscious control of the swing, unnecessary muscle tension, self-doubt and loss of concentration, all of which negatively impact the swing.

Practicing with the training apparatus of the present invention enables a golfer to build this "biometrical clock" system into his swing by providing absolute and correct boundaries. These boundaries are the optimal "window of time" in which to practice one's unique rhythm and one's unique physical motor skills associated with such rhythm. This window of time is the 0.85-1.15 seconds mentioned previously. The device can be adjusted to deliver the golf ball, from takeaway to impact, in an elapsed time similar to the time taken by skilled golfers. Of course, different times can also be used, depending on the skill level of the golfer. By practicing in this manner, a golfer can develop his own unique athletic motions required to swing within similar times of skilled golfers. After developing and exercising these motions sufficiently, with the device, the golfer can then attempt to perform these motions with a stationary golf ball.

With the training device of the present invention, the ball is either present to strike at the impact zone or it is not when the golfer takes his swing. It provides the golfer with immediate feedback. With repeated use of this device, the golfer can develop rhythm, tempo and timing in an athletic, instinctual and automatic way.

During Peak Performance, elite athletes perform their skills with synergy of the mind and body. They are in a mental state of consciousness characterized by high confidence, focus, low anxiety and low tension. They are able to perform their skills using instinct. They are not thinking about how to perform their skills; rather, they are unconsciously executing their skills. This unconscious ability to perform these motor skills is known, by some, as Automatic Processing.

Many amateur golfers do the exact opposite, using Control Processing to execute their skills. Control Processing can be explained as thinking and analyzing the movements associated with athletic skills, during the execution of those skills. Many amateurs try to guarantee their success on the golf course by consciously monitoring and checking the procedure of movements involved in, what they believe to be, a well performed golf swing. This behavior tends to be developed when learning and practicing the swing. The golf swing is one of the most difficult athletic moves to learn, so of course, certain levels of control processing must be used in learning and practicing. However, with the overwhelming amount of new golf tips, instructors, books, articles and internet videos (which often contradict one another), control processing often becomes the chosen way for most golfers to learn or improve one's golf swing. This, then develops the habit of executing the swing using primarily control processing. Furthermore, repeated practice with control processing, leads to the habit of control processing during actual play and/or competition. This leads to a very frustrating experience when attempting to play under pressure and/or adversity. Many amateur golfers claim their swing is amazing when they are practicing on the driving range, but when they get to the course their swing falls apart. If these golfers are practicing their swings using MAINLY the control process, then during play or competition, they rarely ever reach the state of Peak Performance. It's no wonder golf is so frustrating for many amateurs. The apparatus and method of the present invention will help a golfer overcome these problems.

In order to reach a state of Peak Performance on the course, an Automatic Process must also be practiced. It is believed that the Automatic Process is more easily practiced when confronted with moving targets. The behavior of intercepting moving targets is an activity that involves distinct perceptual and motor processes of the brain and nervous system. The control of this behavior, which has developed through millions of years of evolution, is essential for animal survival, and is ingrained in our subconscious. It does not serve us well through conscious thought. It is thought that due to the stationary nature of the golf ball, the areas of the brain that activate this instinctual behavior are not as easily stimulated as they are with moving-ball sports. Consequently, it is thought, that the brain defaults to its more logical and calculating areas when confronted with the stationary golf ball. Unfortunately, these areas tend to be counter-productive in sports and athletic body movements. This may be a significant source of frustration for many golfers. Since the golf swing is difficult to control by conscious thought, it is desirable to have a golf swing training device that stimulates the areas of the brain involving this instinctual behavior during the practice of golf. By practicing in this manner, one can exercise these areas of the brain and develop the athletic instinct required to strike a moving golf ball (within the elapsed times of skilled golfers). With sufficient practice with a device made in accordance with aspects of the present invention, one can utilize automatic control processing when striking a stationary golf ball. Some sports psychologists refer to mastering the use of the mind and body in this regard as being in "The Zone." Automatic Processing must be practice in order to reach the state of Peak Performance or the "Zone." Until now there have not been golf practice aids that allow one to practice this important part of golf this intuitively.

In addition, by learning to perform in this manner, a golfer can reserve mental energy for the logical and calculating areas of the brain which are more suited for decision making and shot strategy on the golf course.

A common fault of average amateur golfers is what is known as "slicing." This is primarily caused by what is known as "coming over the top" or "coming from the outside." This is where the path of the golfers club strikes the ball on a path that starts outside the target line, comes across the ball and then moves inside the target line. Although it may be advantageous for skilled golfers to strike a ball in this manner for shot shaping, it is disastrous for beginners or high handicap golfers to learn to swing on this path. It would more beneficial for these golfers to learn to approach the ball from inside the Targetline. However, striking the ball from inside the target line is a difficult thing for a beginner or high handicap golfer to conceptualize, let alone execute. The training device of the present invention can be adjusted to vary the angle and direction in which the ball is propelled towards the target line/impact zone, thereby allowing the golfer to practice a variety of swing paths.

In one embodiment, to learn to strike the ball from the inside, the ramp of the device is set on a particular angle. The angle the ball is propelled towards the impact zone/targetline will be described in way that references an analog clock. Imagine if a large clock were underneath the golfer. 9 o'clock and 3 o'clock would fall directly on the targetline. They would each fall a foot outside the golfer's shoulders. 9 o'clock would be on the side closest to the ultimate target. The center of the clock would be on the impact zone of the golf ball. To practice coming from the inside, the golfer would set up the device so the angle of the ramp would start in between 10 and 11 o'clock and end aiming directly toward the impact zone. Since the ball is moving towards the impact zone on this angle, the golfer should instinctually close the gap at the optimal point of interception, which is from inside the target line in this example. Because of the position of the ultimate target, the golfer will attempt to propel the ball forward along the target line.

In another embodiment, the ramp is set up and an angle between 1 and 2 o'clock. This gets the golfer to follow through and try to "catch up" to the ball.

Two other common swing faults of average amateur golfers are known as "Casting" and "Deceleration." Both of these faults can be associated with poor rhythm, tempo and timing. Casting is an over-acceleration of the swing during the initial phase of the downswing causing a substantial loss of leverage and power. Deceleration is when the golfer slows his body, hands and ultimately the speed of the club head approaching and through impact. Deceleration can be thought of as the equivalent of slamming the brakes of your car just as you approach the apex of a u shaped curved road. The correct thing to do is accelerate the car through and out of the curve. The same is true in the impact zone of golf.

The training device of the present invention releases a ball to roll down a ramp directly onto the hitting surface towards the impact zone in a manner where the future location of the ball in the impact zone can be instinctually predicted by golfer. The golfer will likely not rush or over-accelerate from the top because the golfer will have calculated when the ball will arrive at the impact position. Likewise, the golfer will not decelerate, because he will instinctually know that if he slows down, he will miss the ball and it will roll through the target line. The golfer's only choice, coming into the impact zone, is to accelerate appropriately to intercept the ball and propel it towards the ultimate target. By practicing in this manner, the golfer can develop the athletic motion required to have patience during the transition and then accelerate through the impact zone (all while doing this within similar elapsed times of skilled golfers). After practicing this motion sufficiently with the device, the golfer can then attempt to perform this motion with a stationary golf ball.

If you haven't heard the term "keep your eye on ball" then you have probably never picked up a golf club. It's no secret that keeping your eye on the ball is beneficial for golf performance. Thinking about this makes sense and performing it seems like an easy task. However, there are a quite a few things at work here that one may not be aware of. For example, In order for a person to accurately reach for a stationary object, the human visuomotor system must separate information about that stationary target from background retinal motion signals. According to scientists at the department of psychology at The University of Western Ontario, the visuomotor system did not distinguish between these two information sources when observers made fast reaching movements to a briefly presented stationary target while the motion of a distant and unrelated stimulus was also visible. The observers' reaching hands shifted briefly in a direction consistent with the motion of the distant unrelated stimulus. Background motion signals may be, for example, the clubhead moving on the takeaway (which many golfers don't even realize they watch). Further background motion could be caused simply by our own movement. Our brain generates eye movements to compensate for head movements. Our brain then needs to determine if those eye movements were due to tracking a moving target or if objects in our view are stationary. It is possible for our brains to perceive a stationary object as one in motion, especially if our head and or eyes are moving at the same time. For example, when we watch a movie we are simply watching a series of stationary images that appear to be in motion. By practicing with this device, a golfer develop an intent visual focus on the ball. After practicing sufficiently with the device, the golfer can then attempt to perform a swing with stationary golf ball.

A method of the present invention will now be described, referring to FIGS. 1-6. In these figures, a training device 10 made in accordance with the present invention feeds golf balls 8 to a golfer by rolling them to the golfer when the device is triggered by the golfer's backswing.

Figure 1:
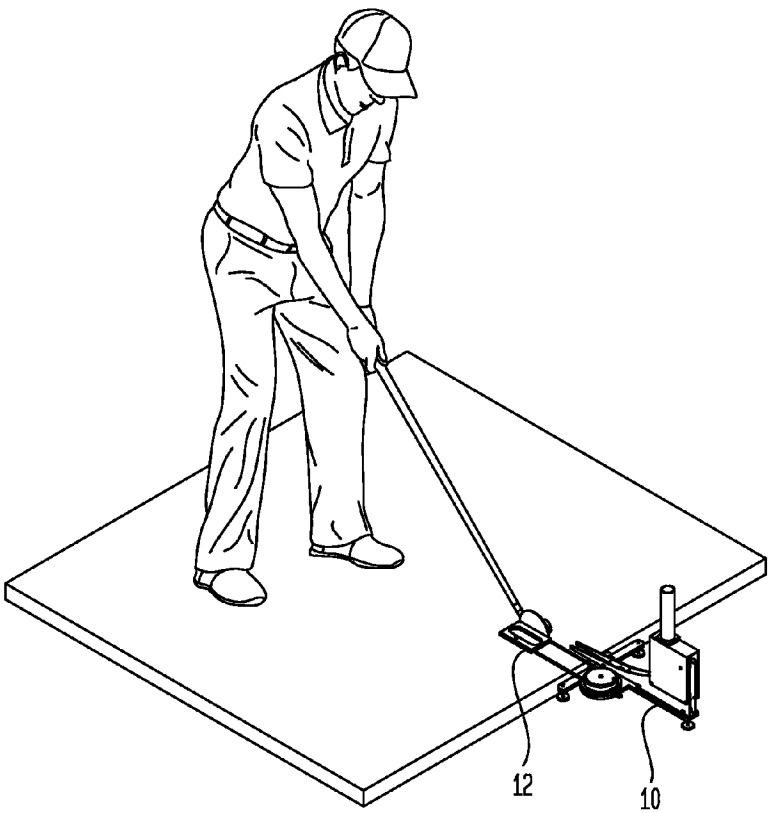
FIG. 1 illustrates a first step in accordance with an aspect of the present invention.

FIG. 1 illustrates a first step in accordance with an aspect of the present invention, showing the address position. Here, the golfer places the golf head in a normal address position. The golf head is placed in front of a trigger arm 12 of the training device 10.

FIG. 2 illustrates a second step in accordance with an aspect of the present invention, showing the takeaway. As the clubhead is taken back, it contacts the trigger arm 12. When the trigger arm is contacted it swings backward in a manner that will be described later.

Figure 3:
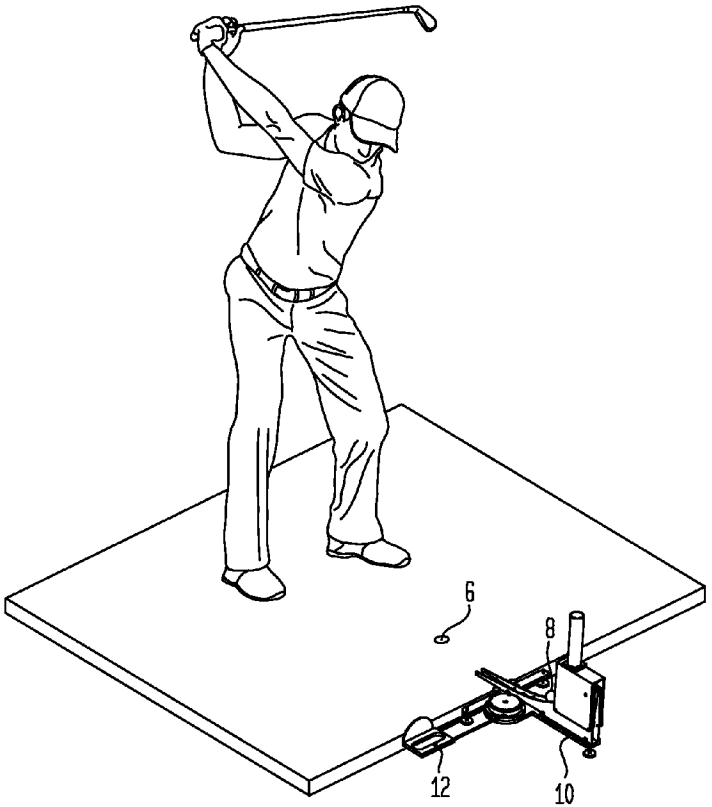
FIG. 3 illustrates a third step in accordance with an aspect of the present invention.

FIG. 3 illustrates a third step in accordance with an aspect of the present invention, where the device 10 releases a golf ball 8. The movement of the trigger arm causes the device 10 to release the golf ball 8. At this time, the golfer is about at the top of the golf swing. In accordance with an aspect of the present invention, the device 10 emits an audio sound which is meant to act as a cue for the golfer to start the downswing.

Figure 4:
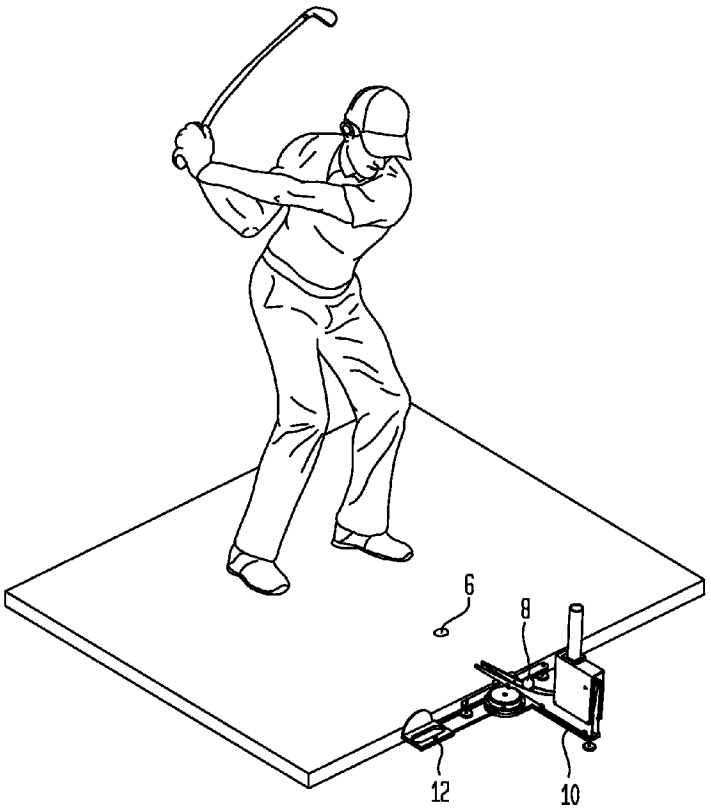
FIG. 4 illustrates a fourth step in accordance with an aspect of the present invention.

FIG. 4 illustrates a fourth step in accordance with an aspect of the present invention where the golf ball 8 is starting to roll down a ramp on the device 10. The golfer is starting the swing to intercept the ball that is rolling down the ramp. A mark 6 (such as + or O) may be placed at the spot where the ball should preferably be struck.

Figure 5:
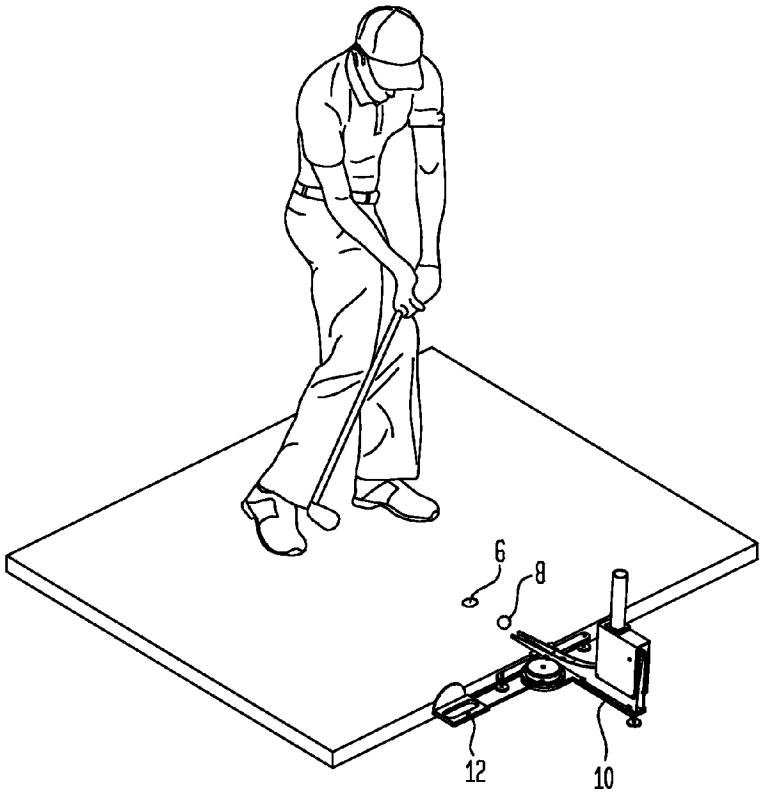
FIG. 5 illustrates a fifth step in accordance with an aspect of the present invention.

FIG. 5 illustrates a fifth step in accordance with an aspect of the present invention where the golf ball 8 has rolled onto a mat or other suitable surface. The ball preferably rolls directly onto the mat without imparting any bounce.

Figure 6:
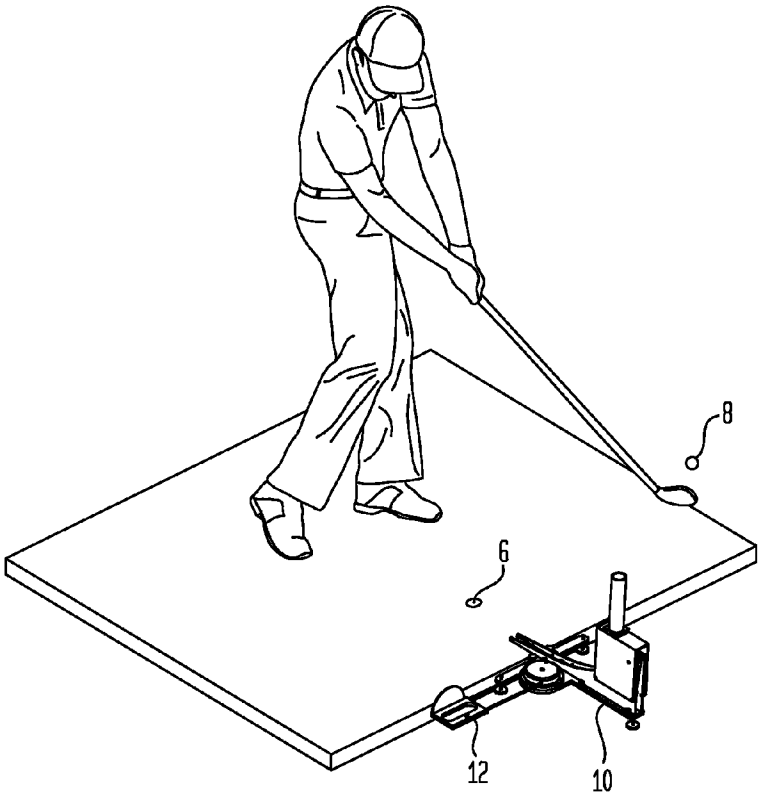
FIG. 6 illustrates a sixth step in accordance with an aspect of the present invention.

FIG. 6 illustrates a sixth step in accordance with an aspect of the present invention where the golfer impacts the rolling golf ball 8 with the golf swing, again preferably at the mark 6.

FIGS. 1 through 6 illustrate further aspects of a method of the present invention in use. In these figures, a mark 6 has been made on the ground showing the preferred interception point of the golf ball 8 as it rolls off the device 10. The mark 6 can be any shape, such as an + or a O. The mark 6 can be made with a template that has a + or an O in it. Chalk or sprayable powder can be used to make the mark 6 on the ground through the template. A blotter filled with chalk can also be used to make the mark 6.

Figure 7:
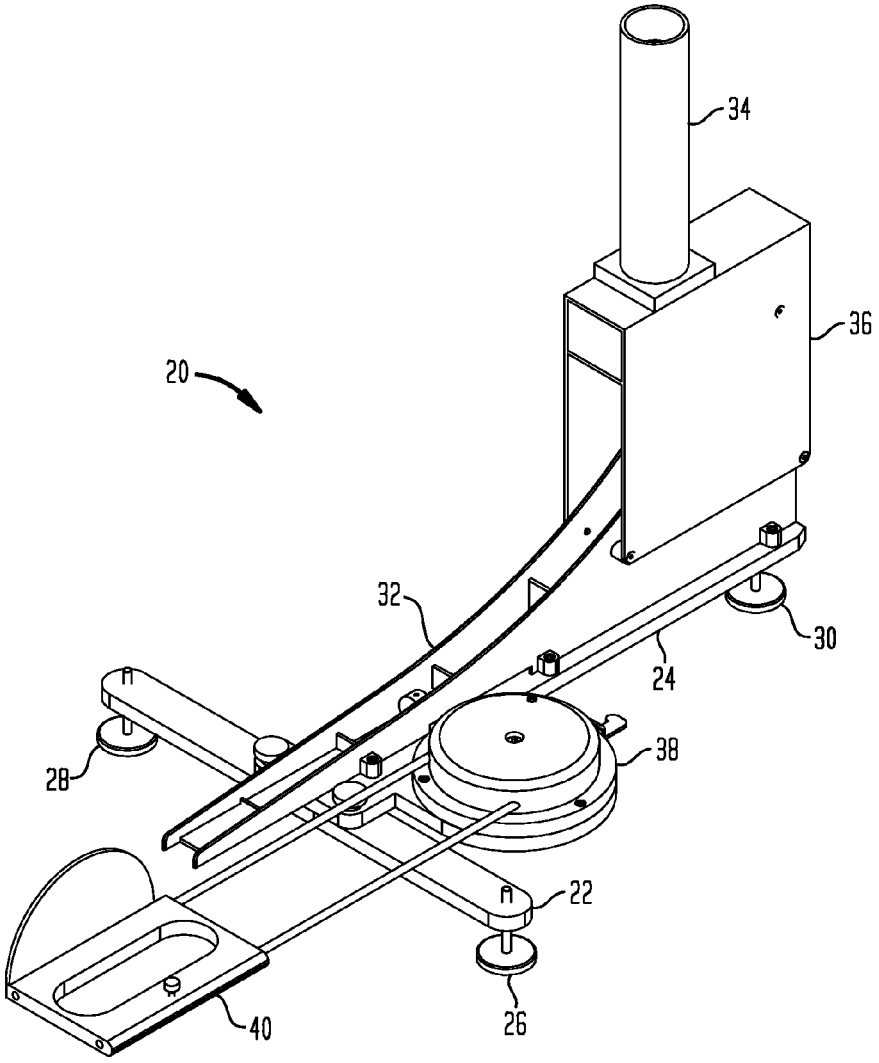
FIG. 7 illustrates a perspective view of an embodiment of the golf training device in accordance with an aspect of the present invention.
Figure 13:
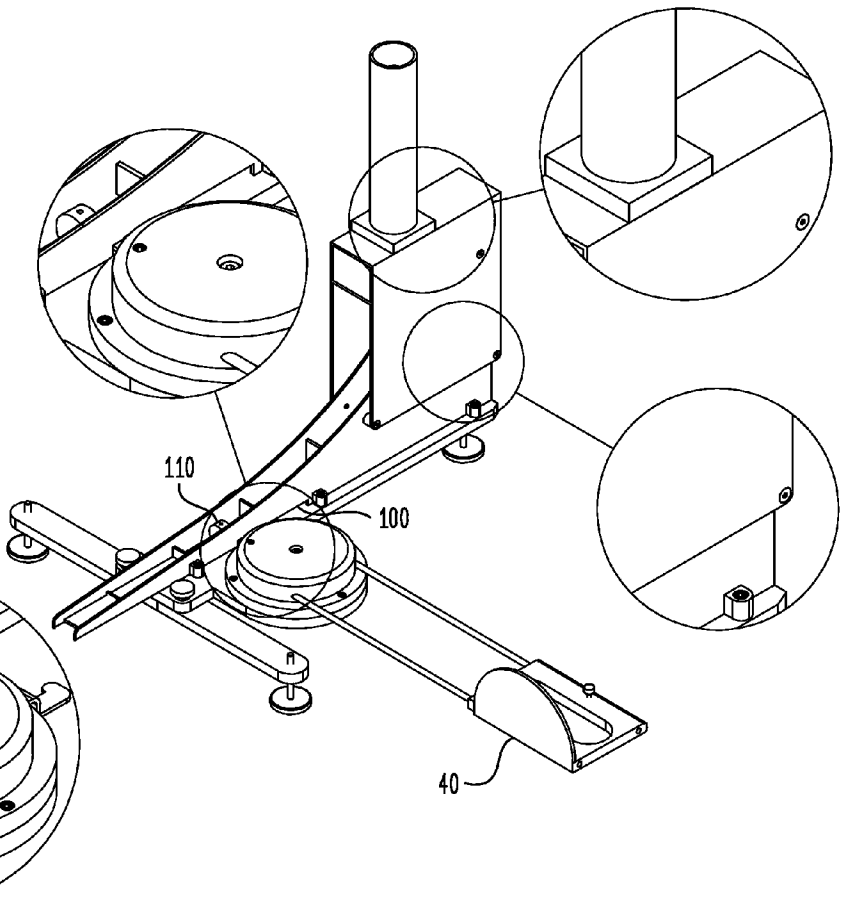
FIG. 13 illustrates another expanded view of the golf training device of FIG. 7 in accordance with an aspect of the present invention showing a trigger arm in a second position.
Figures 14, 15:
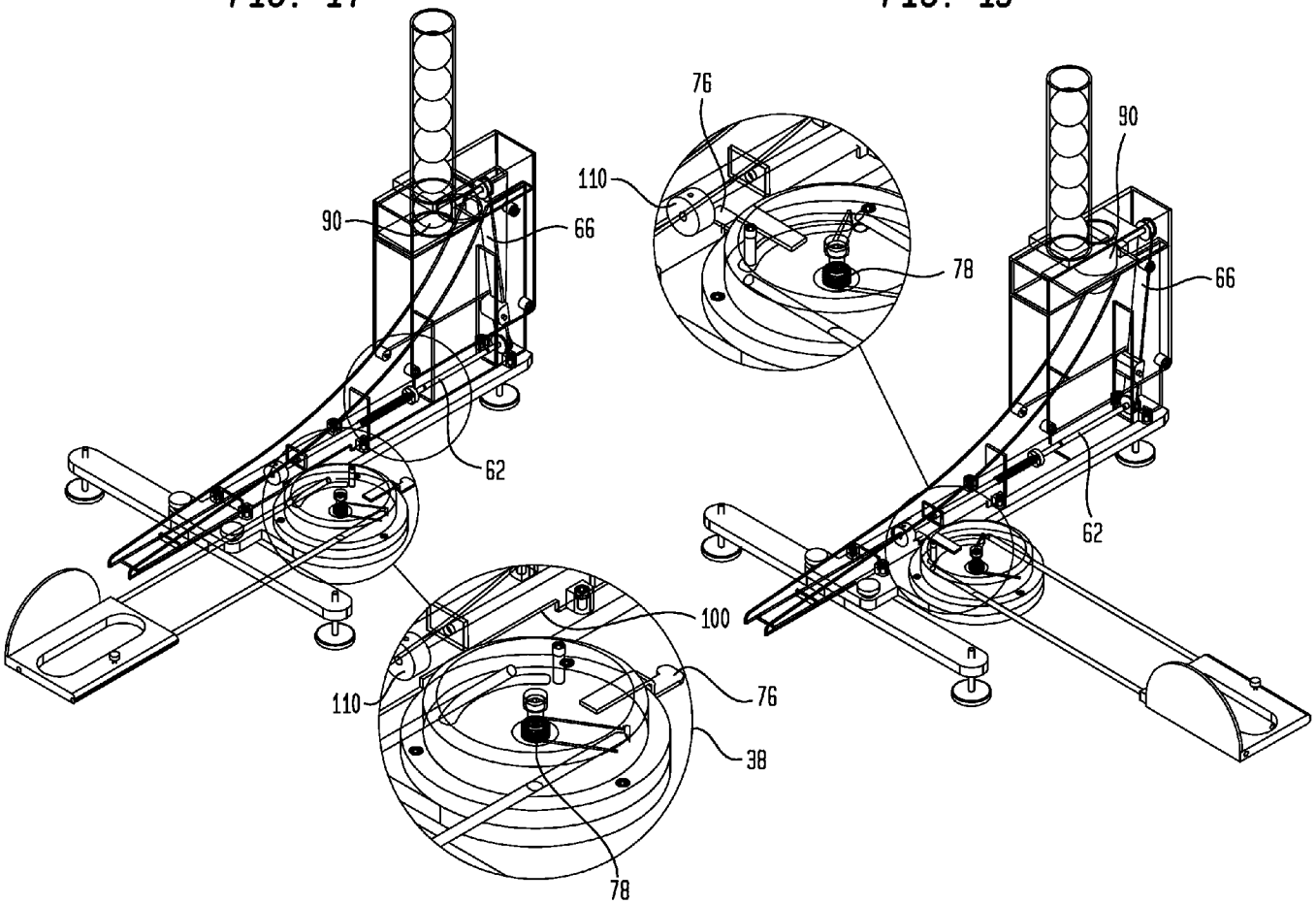
FIG. 14 illustrates a transparent expanded view of FIG. 12.
FIG. 15 illustrates a transparent expanded view of FIG. 13.

FIG. 7 illustrates a perspective view of an embodiment of the golf training device, depicted as device 20, in accordance with an aspect of the present invention. The device 20 includes a first support bar 22 that runs from one side to the other side of device 20. It also includes a second support bar 24 that runs from the front to the back of device 20. Legs 26 and 28 are provided on the first support bar 22. The legs 26 and 28 can attached to the first support bar 22 in such a way as to provide adjustable height, including but not limited to by way of screwing into the first support bar 22. Leg 30 is provided on the second support bar 24. The leg 30 can be attached to the second support bar 24 in such a way as to provide adjustable height, including but not limited to by way of screwing into the second support bar 24. A ramp 32 is provided on top of the second support bar 24. A golf ball container 34 is provided on a housing 36. In one embodiment, a torque assembly 38 is attached to both the second support bar 24 and to a trigger arm 40. In other embodiments, the torque assembly 38 is attached to either the second support bar 24 or to the trigger arm 40 or to neither and instead attached to another part of device 20. The torque assembly 38 is spring loaded. When the trigger arm 40 is moved backward by the backswing of a golf club, the torque assembly 38 rotates in a counterclockwise direction, as illustrated in FIGS. 13 and 15 discussed below. The rotation of the torque assembly 38 causes a golf ball held in the container 34 to be released down the ramp 32 so it can be struck as it rolls across a mat, as previously described.

Figure 8:
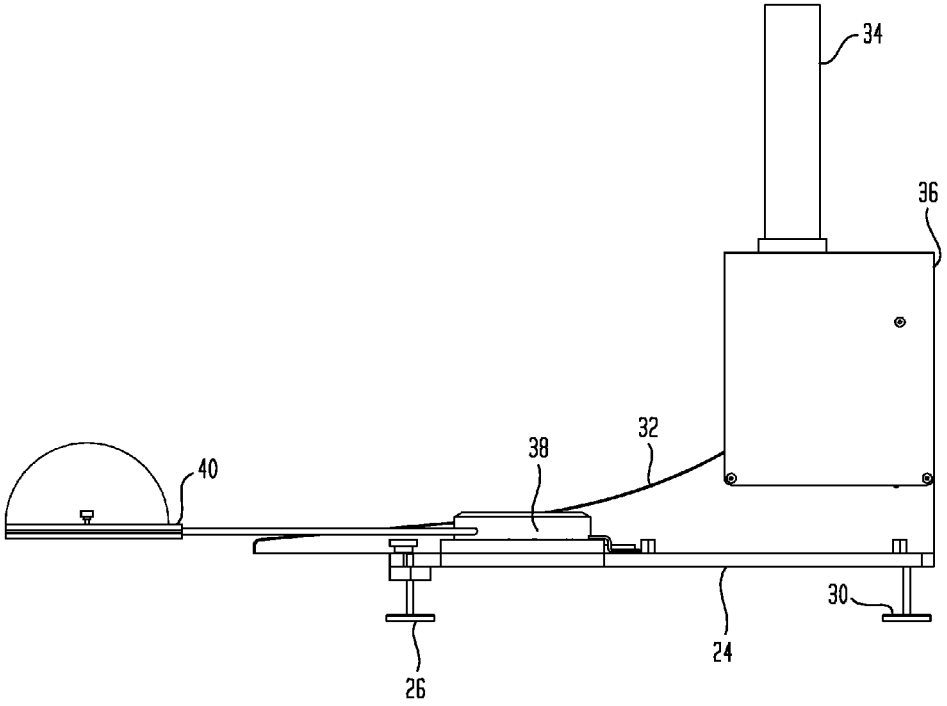
FIG. 8 illustrates a side view of the golf training device of FIG. 7 in accordance with an aspect of the present invention.
Figure 9:
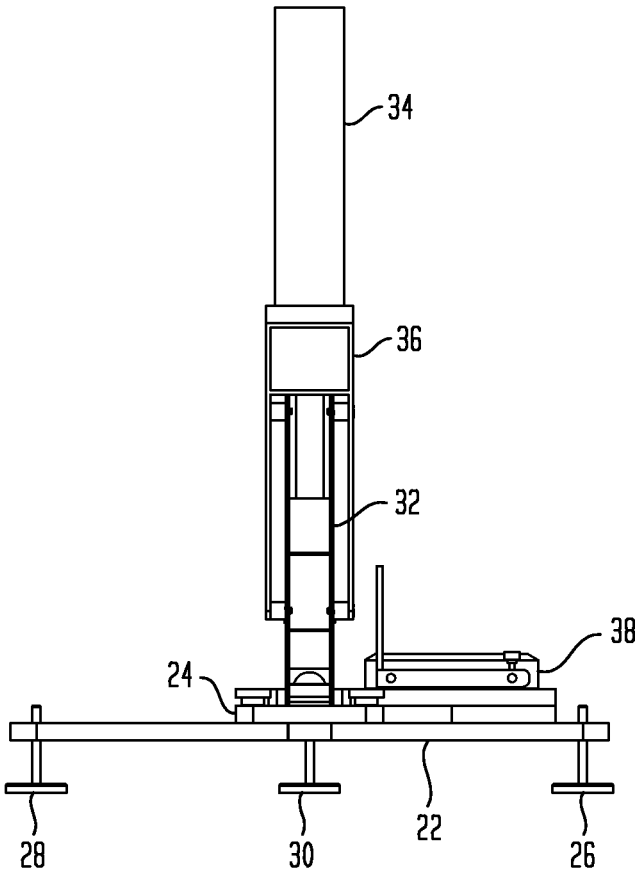
FIG. 9 illustrates a front view of the golf training device of FIG. 7 in accordance with an aspect of the present invention.
Figure 10:
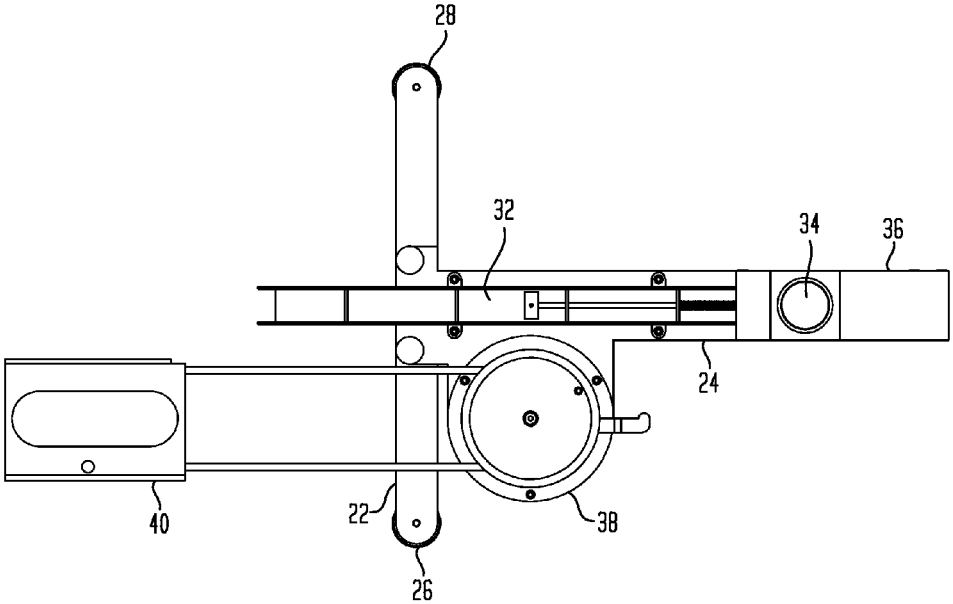
FIG. 10 illustrates a top view of the golf training device of FIG. 7 in accordance with an aspect of the present invention.

The first support bar 22, the second support bar 24, the legs 26, 28 and 30, the ramp 32, the golf ball container 34, the housing 36, the torque assembly 38 and the trigger arm 40 are shown in a side view of the device 20 in FIG. 8, in a front view of the device in FIG. 9 and in a top view of the device in FIG. 10.

Figure 11:
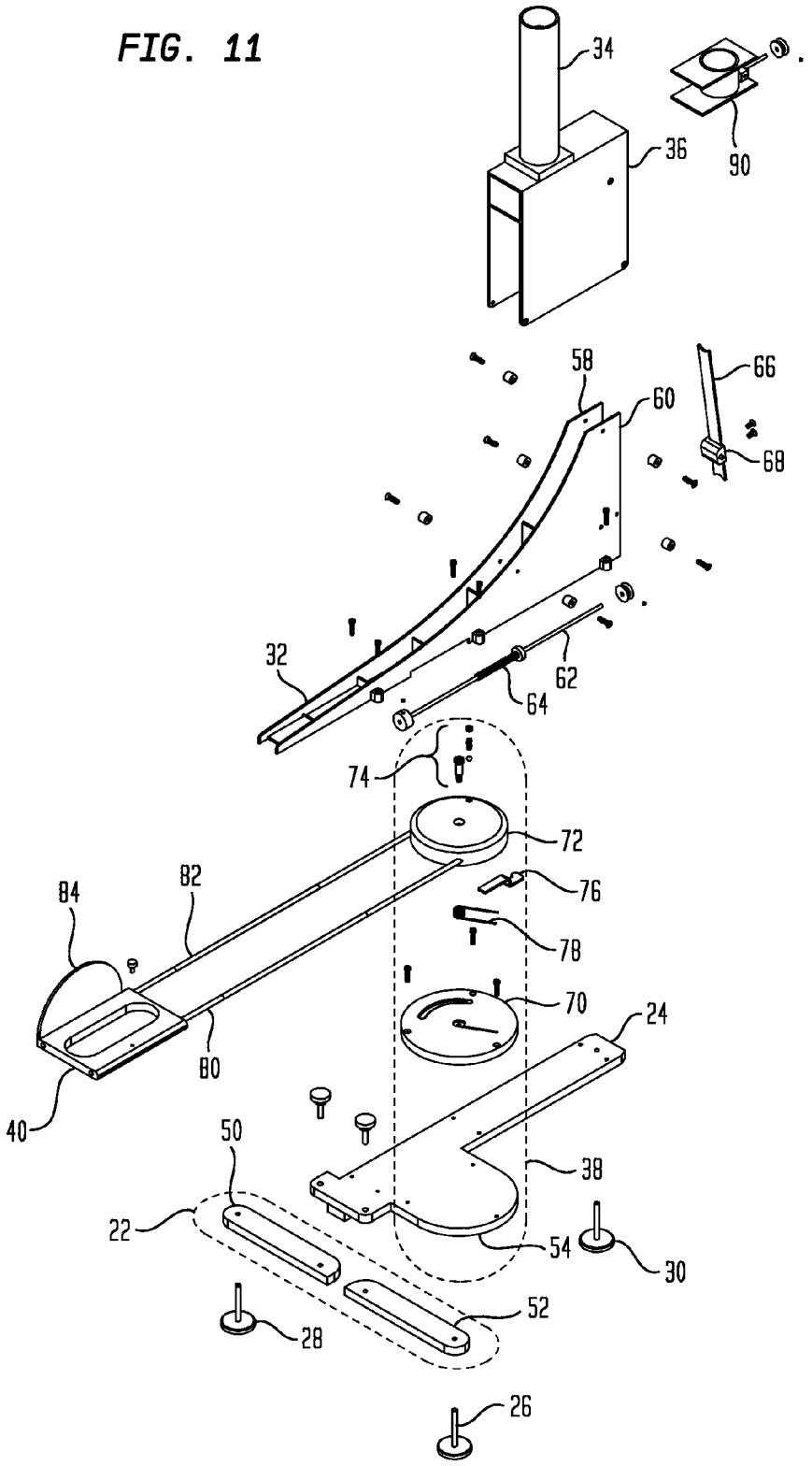
FIG. 11 illustrates an exploded view of the golf training device of FIG. 7 in accordance with an aspect of the present invention.

FIG. 11 illustrates an exploded view of the golf training device of FIG. 7 in accordance with an aspect of the present invention. The first support bar 22 can be made from pieces 50 and 52. FIG. 11 further illustrates the second support bar 24, the legs 26, 28 and 30, the ramp 32, the golf ball container 34, the housing 36, the torque assembly 38 and the trigger arm 40. The second support bar 24 includes an extension 54 that forms the bottom of the torque assembly 38.

The ramp 32 is formed of two parts 58 and 60. These parts 58 and 60 of the ramp are held together, for example, with slats and bolts which are shown in FIG. 11 and referred to in FIG. 18 as slats 130-135. A rod 62 is held in place inside the ramp 32. A spring 64 surrounds a portion of the rod 62 to bias the rod 62 in place. The end of the rod 62 is attached to a lever 66. The lever 66 is attached between the ramp parts 58 and 60 by a bolt that runs through a pivot 68 attached to lever 66.

Figure 16:
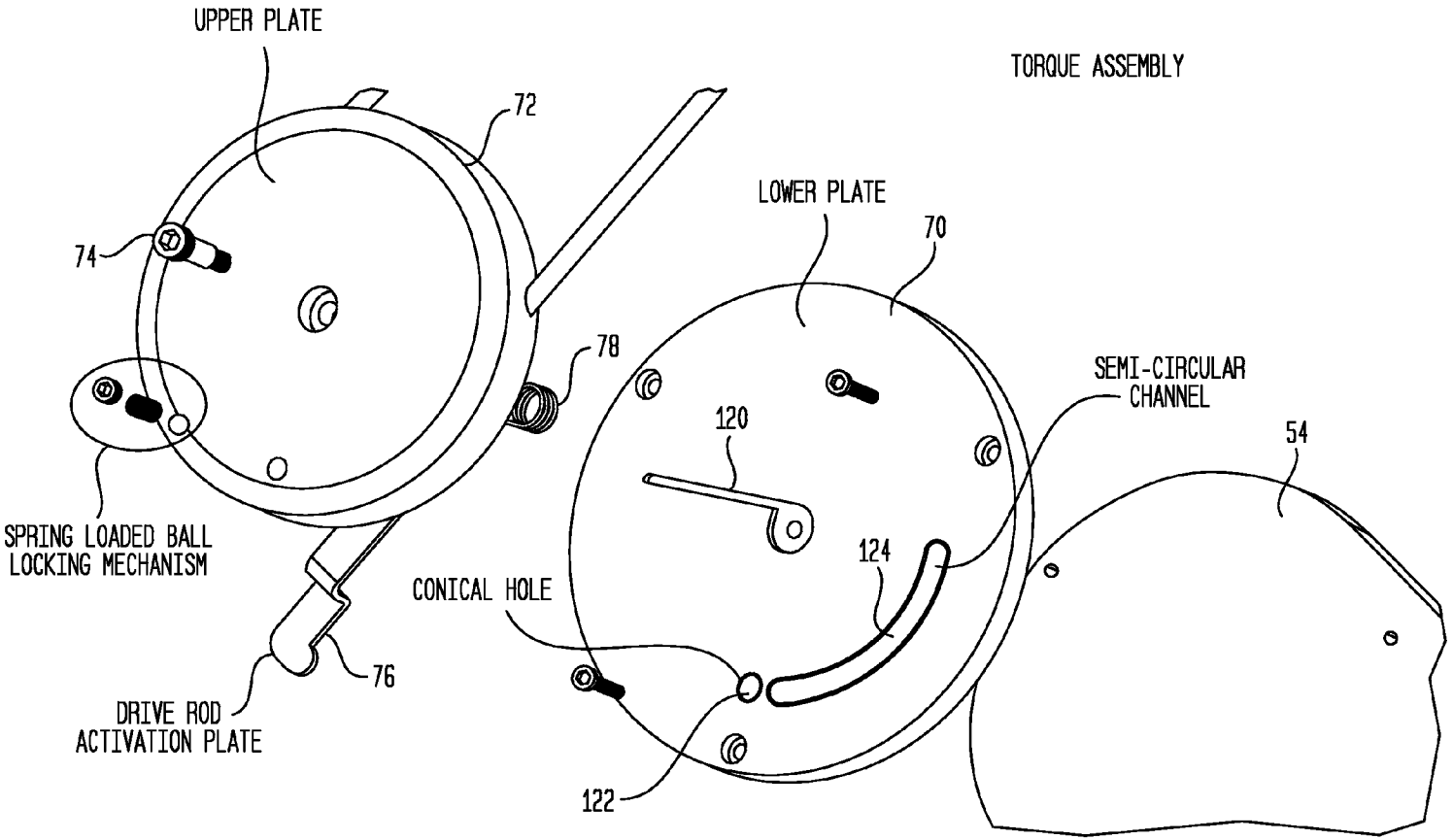
FIGS. 16 and 17 show exploded views of a torque assembly of the golf training device of FIG. 7 in accordance with an aspect of the present invention.
Figure 17:
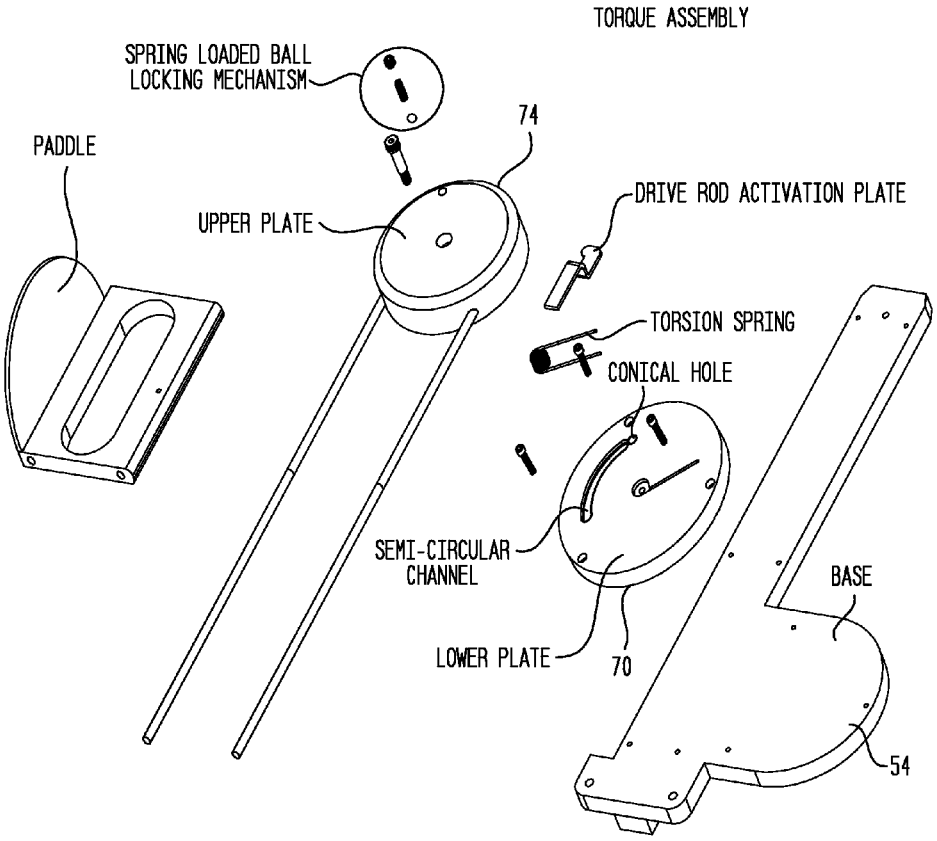

With additional reference to FIGS. 16 and 17, the torque assembly 38 has a plate 70 that is held in place between the extension 54 and a top plate 72. There is a spring loaded plunger assembly 74 held in place inside the torque assembly 38. A tab 76 extends from the torque assembly 38. Additionally a torsion spring 78 is held in place inside the torque assembly 38. The trigger arm 40 includes two wire arms 80 and 82 that are connected to the torque assembly 38 and that extend from the torque assembly 38. Trigger arm 40 is attached to the two wire arms 80 and 82 at the other end of the arms.

With additional reference to FIGS. 7 to 11, 14 and 15, the golf ball container 34 is attached to the housing 36. The housing 36 is attached to the ramp parts 58 and 60. A ball mover 90 is held in place inside the housing 36. The ball mover 90 is attached to the top end of the lever 66. The bottom end of the lever 66 is attached to the rod 62. Thus, when the rod 62 is moved forward, the rod 62 pulls the bottom part of the lever 66 forward, so that the top part of the lever 66 pulls the ball mover 90 backward. A ball in the ball mover 90 drops a ball through a hole onto the ramp 32.

Figure 12:
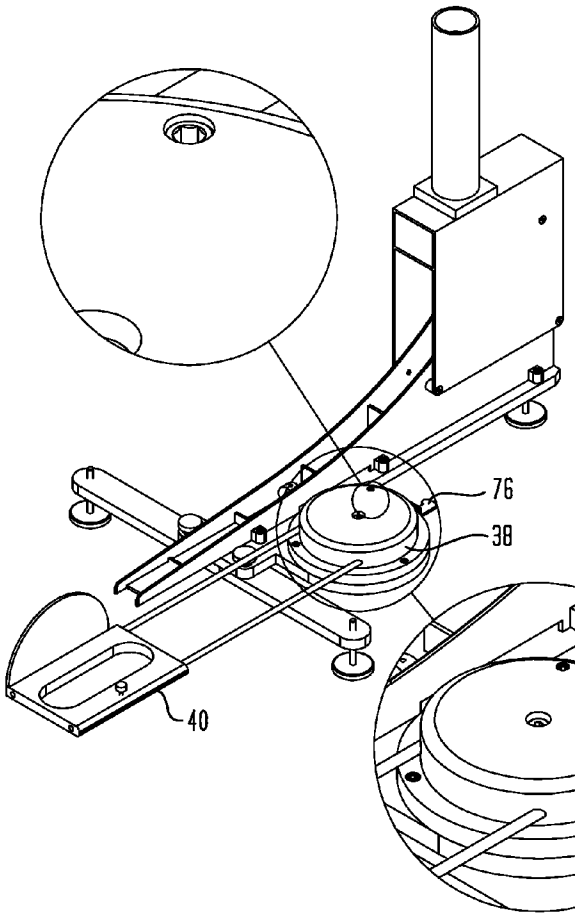
FIG. 12 illustrates an expanded view of the golf training device of FIG. 7 in accordance with an aspect of the present invention showing a trigger arm in a first position.

FIGS. 12 through 15 illustrate another expanded view of the golf training device of FIG. 7 in accordance with an aspect of the present invention. In FIG. 12, the trigger arm 40 is waiting to be triggered. The tab 76 extends out of the torque assembly 38. After a golf club contacts the trigger arm 40, the torque assembly 38 starts to rotate under the torque applied by the torsion spring 78 inside torque assembly 38. As the torque assembly 38 rotates, the tab 76 rotates with it. As the tab 76 rotates, it slides under an opening 100 in the ramp 60. Once the tab 76 slides under the opening 100, it catches a knob 110 on the rod 62 and pulls the rod 62 forward. As previously described, this action pulls the bottom part of the lever 66 forward, so that the top part of the lever 66 moves in the opposite direction, pulling the ball mover 90 in the same direction as the top part of the lever 66. The ball mover 90 slides over a hole over the ramp 32 and releases a ball onto the ramp 32.

Figure 19:
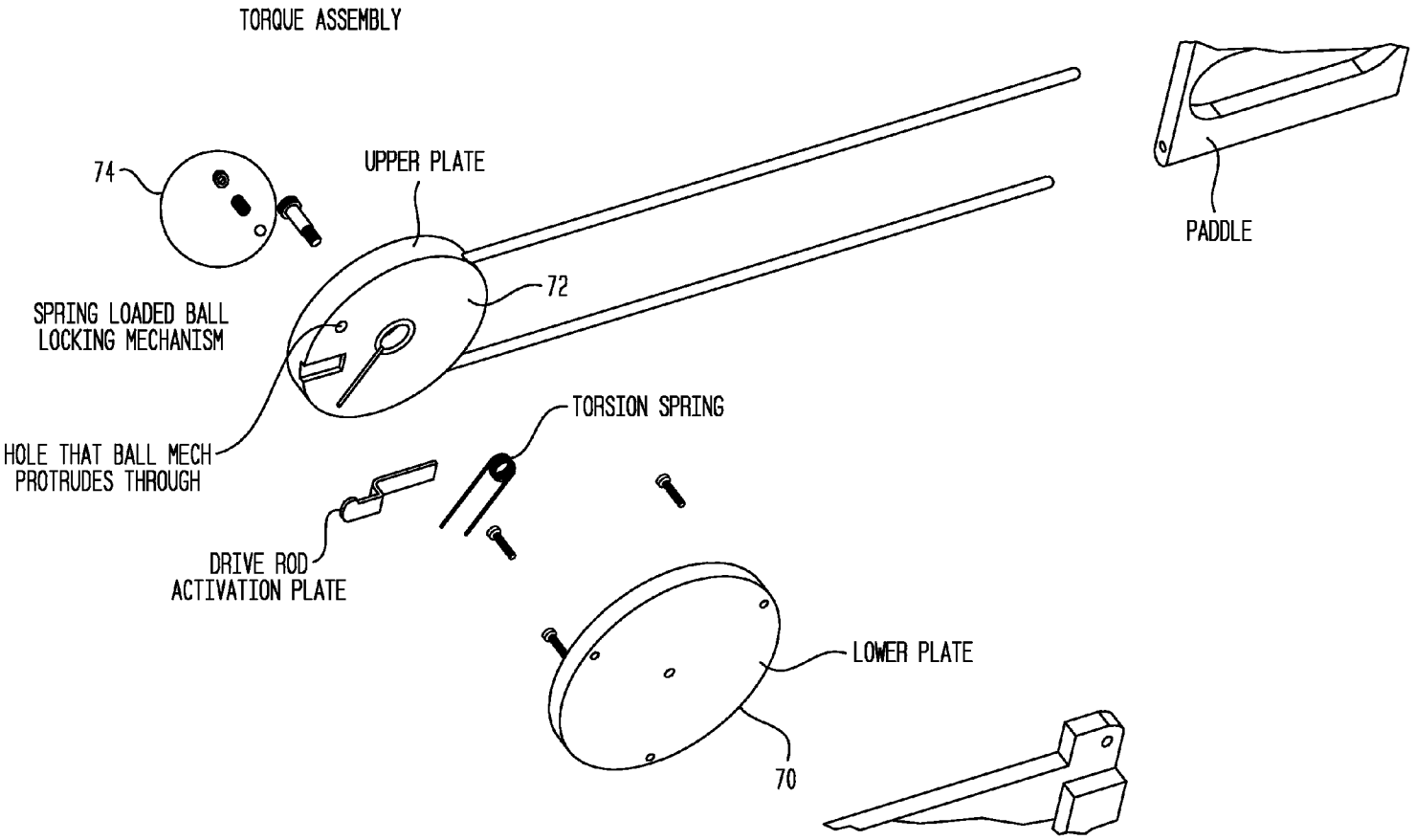
FIG. 19 illustrates further aspects of the first embodiment of the present invention.

FIGS. 16, 17 and 19 show expanded views of the torque assembly 38 of the golf training device of FIG. 7 in accordance with an aspect of the present invention. The extension 54, the plate 70 and the top plate 72 are shown in each figure. The plunger assembly 74 includes a threaded bolt 73 that is screwed into the top plate 72. It also includes a spring and a ball 75 which are housed inside the torque assembly 38. The ball 75 rests in the conical hole 122 in the plate 70. The amount of pressure on the ball 75 depends on how much the threaded bolt 73 is screwed into the top plate 72. The torsion spring 78 rests in the cutout 120 and is also supported by the top plate 72 so that it applies pressure on the top plate 72 to cause it to rotate in a counterclockwise direction. The ball 75 resting in the conical hole 122 resists the rotation so that the torque assembly 38 does not rotate.

Once a golf club contacts the trigger arm 40 on a backswing, pressure is exerted on the ball 75 forcing it upwards and the torque assembly 38 starts to rotate under the force of the torsion spring 78. The ball 75 rises and then falls into the channel 124 housed between the plate 70 and the top plate 72. As explained earlier, the tab 76 catches a knob 110 on the rod 62 and pulls the rod 62 forward to release a golf ball. The torque assembly 38 ends up in the position shown in FIGS. 13 and 15.

When the rod 62 comes forward, the spring 64 on the rod 62 catches part of the ramp 32 to spring the rod 62 backwards into its original position. Then the golfer grabs the end 84 of the trigger arm 40, preferably with a golf club and retracts the torque assembly 38 back into its original position, as shown in FIG. 12. The ball 75 in the plunger assembly 74 retraces its path in the channel 124 and ends up back in the conical hole 122 in the plate 70.

Figure 18:
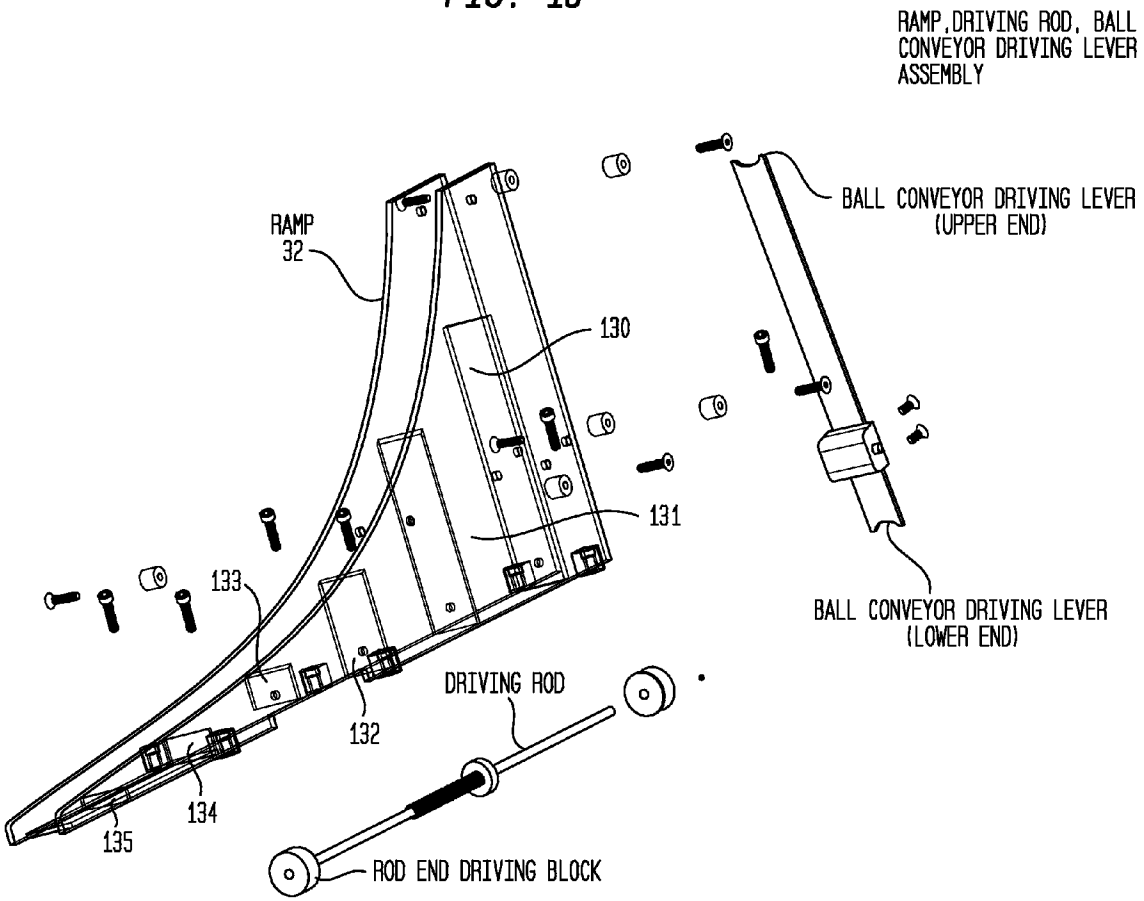
FIG. 18 illustrates an expanded view of a ramp assembly of the golf training device of FIG. 7 in accordance with an aspect of the present invention.

FIG. 18 illustrates further aspects of the golf training device of FIG. 14. The ramp 32 is supported by slats 130-135. As shown, some of the slats have holes to support the rod 62 within the ramp. 32.

In a further embodiment of the present invention, the golf training device can have a different release mechanism. The golf training device can have a similar structure as the previous embodiment; particularly it can have a trigger arm that has the same initial position as in FIG. 12 and that travels backwards when a golf club, during a backswing, contacts the trigger arm until the trigger arm has rotated counterclockwise to a similar position as in FIG. 13. By doing so, a golf ball is released and travels down a ramp as the trigger arm starts to move.

In the further embodiment, the trigger arm is held in an initial position by a bumper. The bumper can be spring loaded to bias it upwards. The bumper holds the trigger arm in place against the counterclockwise rotational force exerted by a spring. When the golf club contacts the trigger arm in a back swing the bumper is forced down by the force of the golf club on the trigger arm. The force of the spring causes the trigger arm to rotate. As before, a notch on the trigger arm contacts a rod inside the golf training device to cause a golf ball to be released in the manner described earlier. The further embodiment may also include a stop that catches the trigger arm to stop it from further rotation. The trigger can be reset by using a golf club or other means to grab the end of the trigger arm to pull it back to a reset position.

A device in accordance with the present invention is preferably calibrated to reach the impact zone from the moment of takeaway to impact in adjustable time lengths of approximately 0.9 seconds to 1.2 seconds. The adjustments are enabled by the height of the ball container and the arc of the ramp. The ramp preferably includes a cycloid section and a linear section, any design can be used to achieve any adjustable time length.

In accordance with another aspect of the present invention, a personal portable device is provided.

A bubble level indicator can also be provided on the device to ensure that the device is level during use.

Right handed and left handed models can be made available.

Referring to the figures, a golf swing training device in accordance with an aspect of the present invention has a calibrated ramp. The ramp is constructed of an inverted cycloid curve, inclined plane or a combination of both. The cycloid curve is used to provide accurate and repeatable timings for the ball delivery to the impact zone.

The feeder and ramp mechanism can propel the ball using any electrical, mechanical, electro-mechanical, gravitational, pneumatic means known in the art. In the figure drawing, a gravitational method is used. A single ball is released down the ramp by a release mechanism triggered by the golfer during the time of his takeaway or backswing. The release mechanism can be triggered by the golfer or the golfer's clubhead during the takeaway or backswing. If it is triggered by the clubhead, the trigger mechanism could be a switch, hinge, gate, laser, pivoting lever, motion sensor, or photogate. If the release is triggered by the golfer, it can be a hand or grip mounted digital/analog button communicating through radio or Bluetooth signals. It may also be triggered by auditory cues from the golfer. In the embodiments described, a pivot with a lever extended behind the impact zone is used whereby it is triggered by the golfer's clubhead.

At the end of the ramp, the ball is propelled onto a floor, grass, artificial turf, golf practice mat or other surface. For the practice of the driver, the device is elevated and the ball drops off the end of the ramp into mid air. However, the golf training device may be made such that the ball rolls onto the surface without bounce.

In accordance with an aspect of the present invention, the ramp ends just before the point of the target line where the golf ball would rest, also known as the "impact zone."

In one embodiment, the device can be adjusted to change the time in which the golf ball is delivered. This can be accomplished in different ways, including by placing components on the ramp to create drag as the golf ball rolls down the ramp.

Preferably, the ramp is constructed of a transparent or translucent material or the top of the ramp is uncovered so that a ball traveling down the ramp is visible at all times. As the device may be accidentally struck by a shanked golf ball and may also be exposed to high levels of sunlight/UV rays, it is preferable that the device is constructed with an impact resistant/UV protected material such as polycarbonate.

In one embodiment, the ramp connects to the ball feeder, a hinge can allow the ramp to fold for portability and storage. A base of the ball feeder can also have supporting legs, which can include a hinge allowing them to fold for portability and storage. The base and the ramp can optionally include the supporting legs. In another embodiment the device can be a fixed mounted piece of equipment for use at a driving range.

Shorter Ramps and Backswing levers for practicing the short game, (Pitching/Chipping) and putting timings can be provided. These will be swappable with the unit to practice these shorter times swings. The shortgame elapsed times for the ball release to impact zone are approximately 0.7 seconds to 0.9 seconds.

The golf swing training device can also be configured to teach young children the golf swing and develop tempo, timing and rhythm. While young children are exploring the world, they often tend to be more stimulated by movement and activities or sports that involve moving objects. It may be frustrating for both parents and children to gain interest in a game that involves a stationary ball such as golf. Since the device propels the ball in motion the child should instinctually understand what to do. The training device for children can use plastic or foam "practice" balls along with a plastic golf club. Because the plastic or foam balls are lighter than a standard golf ball, the ball feeder may include a spring or air loaded device to assist the projection of the ball down the ramp in order to achieve optimal timing. The golf swing training device for children should also incorporate a practice mat, whereby the balls roll from the ramp onto the mat. It is more likely that a child would use this training device in a backyard on longer grass, so the mat may be useful, as opposed to an adult who may use the training device on manicured turf or on a driving range mat. The golf swing training device for children can also incorporate a separate ultimate target that can capture balls. The target can be positioned in the distance along the target line. It can be decorated to capture the child's attention and draw interest for the purpose of the child to have the goal of propelling the moving ball towards the ultimate target.

When using the device the golfer is able to train his focus on the target. The golfer takes his normal address position (e.g., his body square to the target line). The golfer then takes away his club and strikes the release lever that will release a ball down the ramp. After the ball is released, the golfer's eyes will track the ball slowly rolling down the ramp. The golfers brain attempts to predict the intercepting moving target, and he will instinctually calculate when the ball will arrive at the impact zone. Through training, the golfer may develop an instinct to take a backswing and return the club to impact within the similar times as professional golfers. In one embodiment, the ramp can be marked to show the golfer when to begin the downswing—no sooner, no later. Optionally, this golf swing training device can be used with the other training aids designed to make the golfer hit down on the ball. Once the golfer has practiced sufficiently hitting moving targets, he can transpose this new swing and mindset to a stationary target.

As explained above, the ramp can be a cycloid over a part of the ramp and then be linear over the remaining part of the ramp. The size of the ramp and the curvature of the ramp, along with the timing of the audio tone, should be adjusted to provide the preferred timing of a golf swing.

Further Embodiments

FIGS. 20 to 33 illustrate another embodiment of the present invention. The mechanical design of a further embodiment of the present invention is shown in FIGS. 20 to 31.

Figure 20:
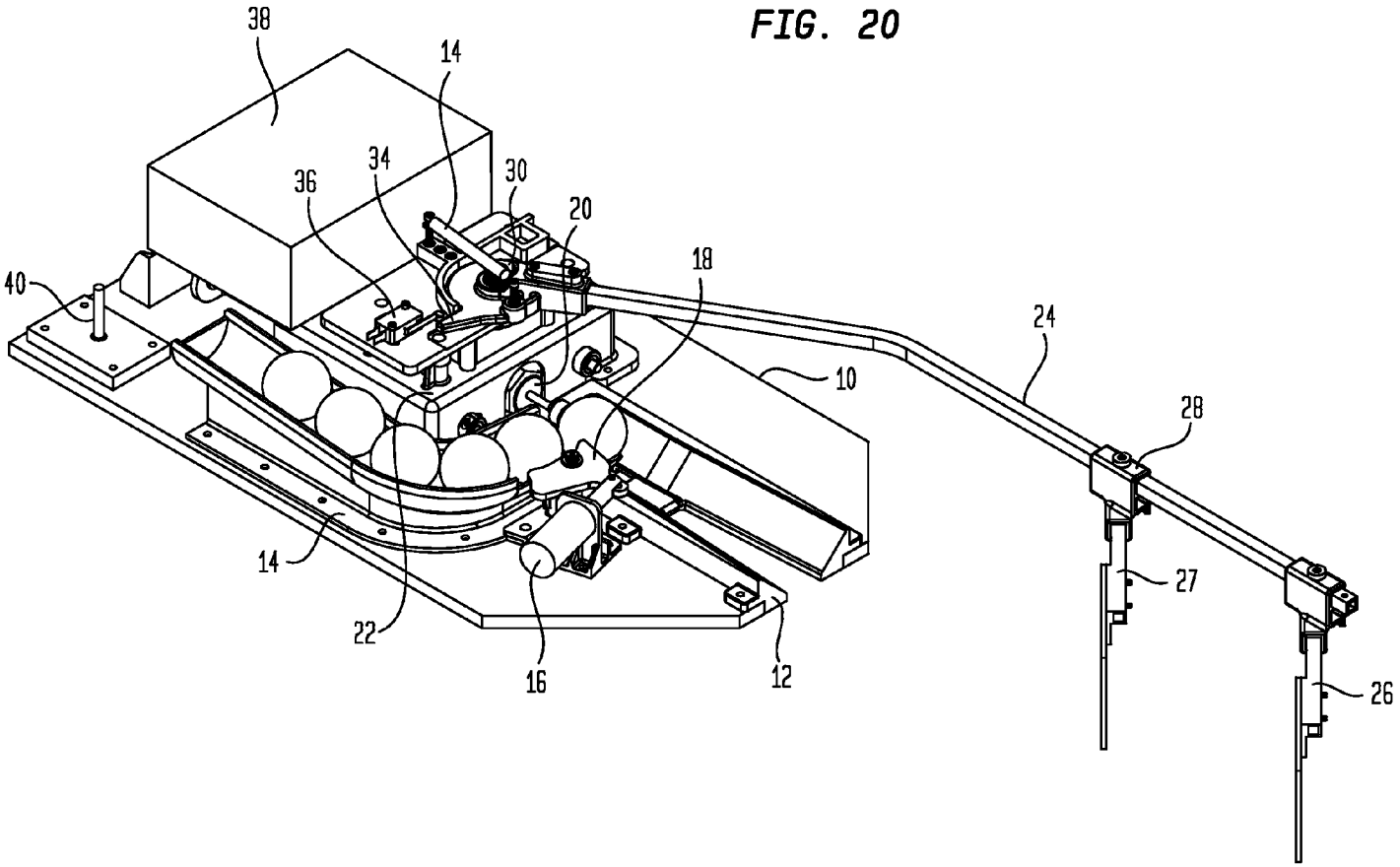
FIG. 20 illustrates the mechanical structure of an uncovered version of a further embodiment of the present invention.

Referring to FIG. 20, an uncovered version of the further embodiment is shown. In accordance with this further embodiment of the present invention, the golf training device includes a base 10, a ramp 12, a holding ramp 14, a holding solenoid 16, a pivoting retainer 18, a firing solenoid 20, a housing 22, an arm 24, a paddle 26, a paddle holder 28, an arm pivot 30, a spring 32, an arm pivot extension 34, a snap switch 36, a second housing 38 and adjustable feet 40 (only one shown). In operation, the holding ramp 14 holds a plurality of golf balls 42.

Figure 21:
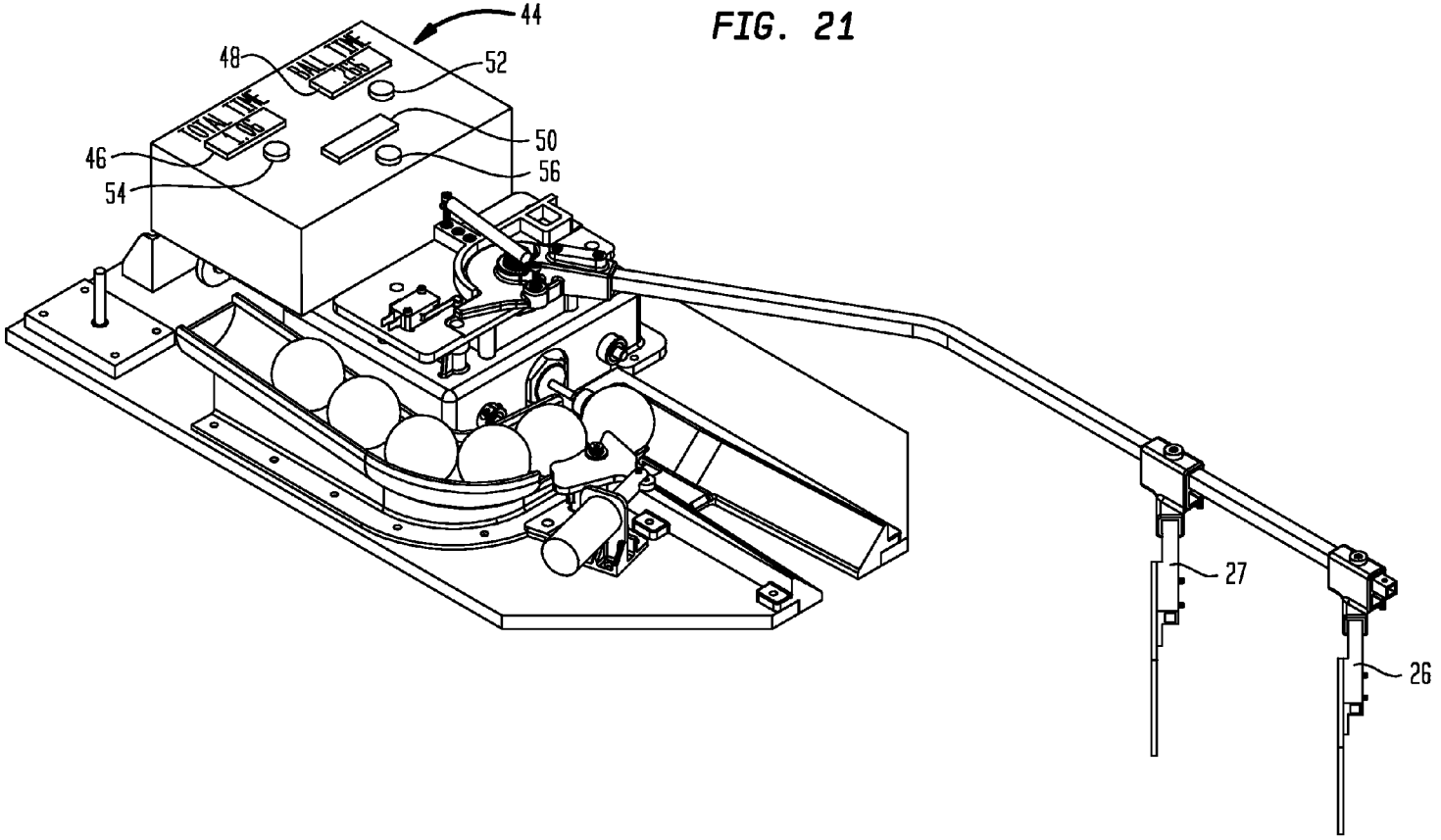
FIG. 21 illustrates the embodiment of FIG. 1 with a user interface.

FIG. 21 illustrates the embodiment of FIG. 20 with a user interface 44 added. The user interface 44 includes three displays 46, 48 and 50. It also includes two knobs 52 and 54, each connected to a potentiometer. The user interface 44 also includes a button 56. As shown in a later figure, these elements in the user interface are connected to a controller.

Figure 22:
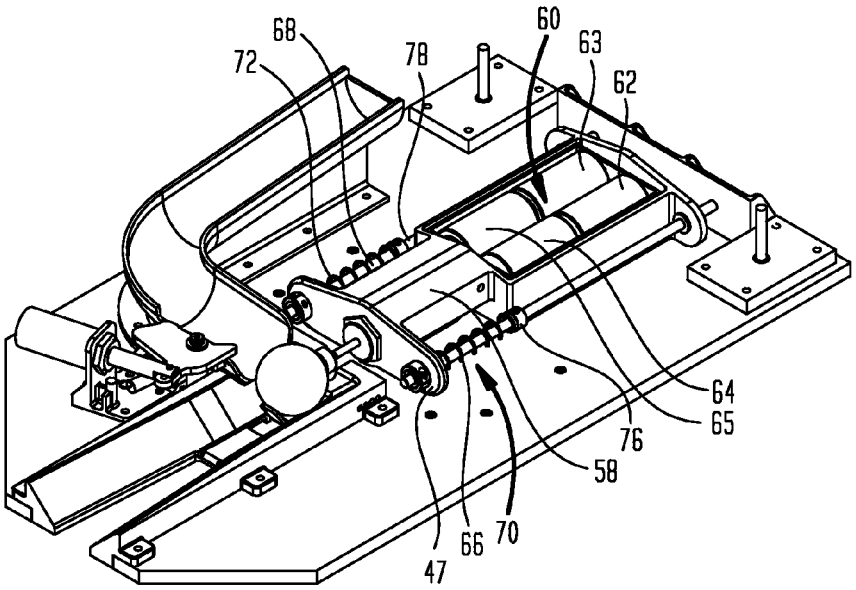
FIGS. 22 and 23 illustrate the embodiment of FIG. 1 with a housing removed to further illustrate a solenoid housing.
Figure 23:
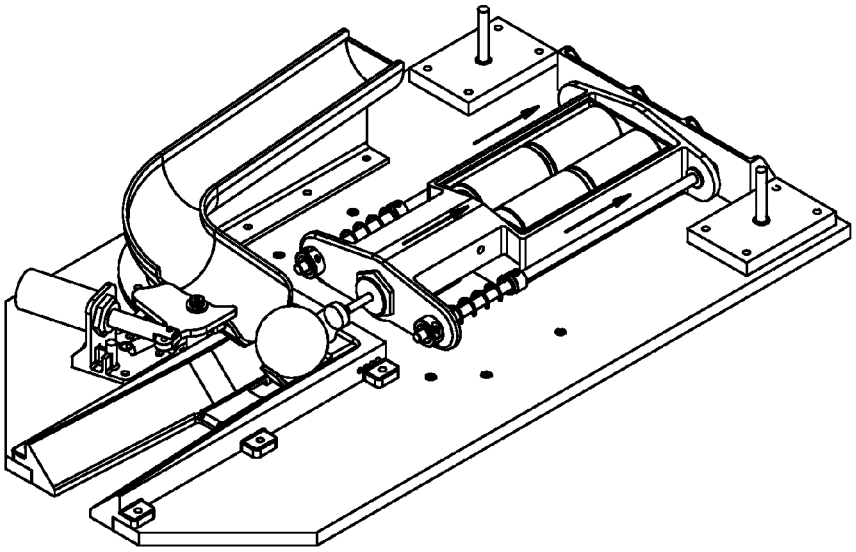

FIGS. 22 and 23 illustrate the embodiment of FIG. 20 with the second housing 38 removed. Removal of the second housing 38 reveals a firing solenoid housing 58 and a battery compartment 60 with four batteries 62 to 65. Two rails 66 and 68 run the length of the housing 58. Springs 70 and 72 are on each of the rails 66 and 68. The springs are located between a forward plate 74 and collars 76 and 78 which are held in place with a set screw. As will be further explained, this structure dampens the force created by firing the solenoid 20 and helps to keep the golf training device in place.

Figure 28:
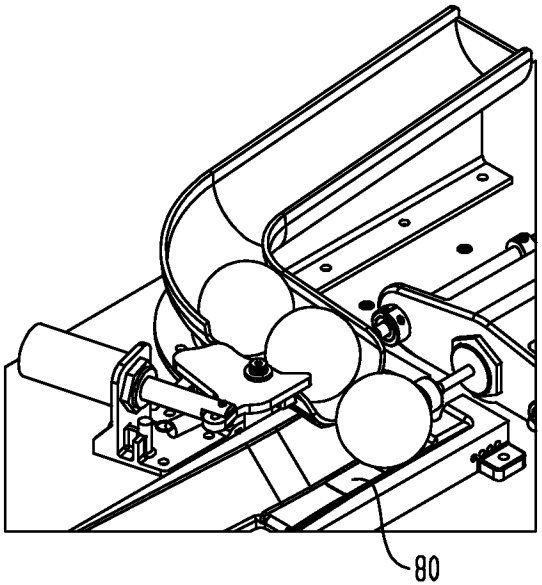
Figure 30:
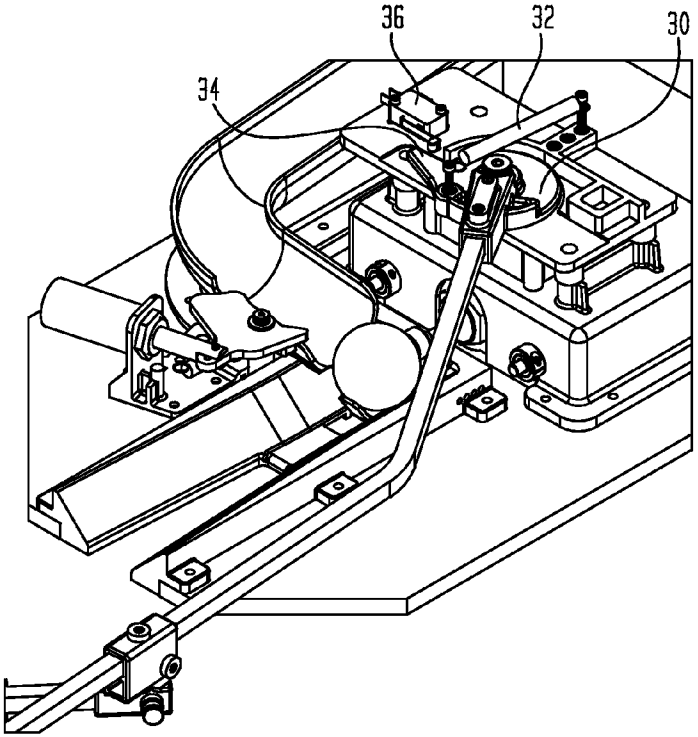
FIGS. 29 and 30 show further details of the relationship between the arm pivot, the spring, an arm pivot extension and a snap switch.
Figure 29:
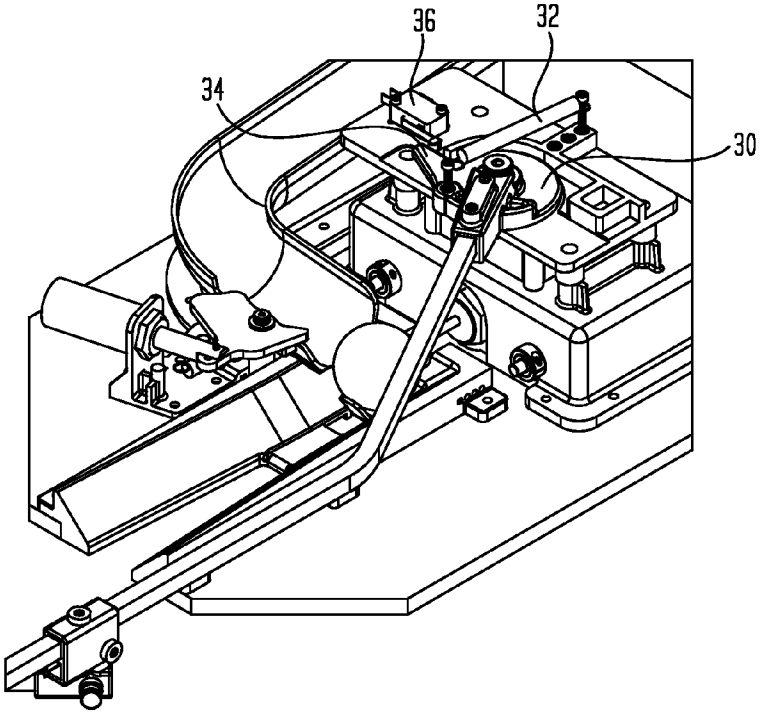
Figure 32:
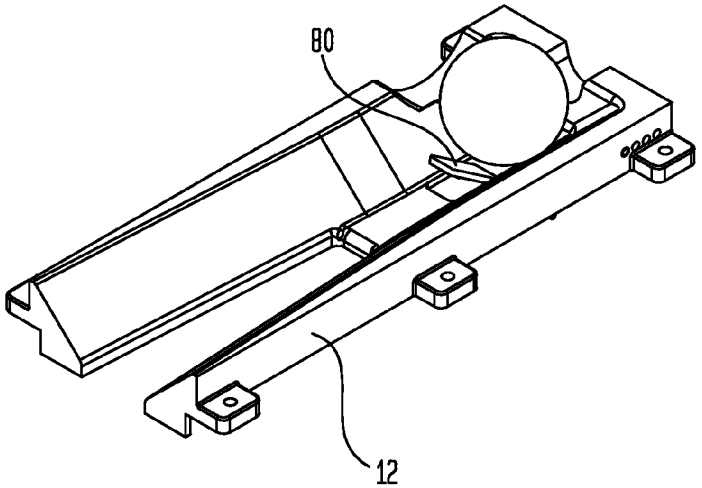
FIGS. 31 and 32 show further details of the firing ramp and a flap 80.
Figure 31:
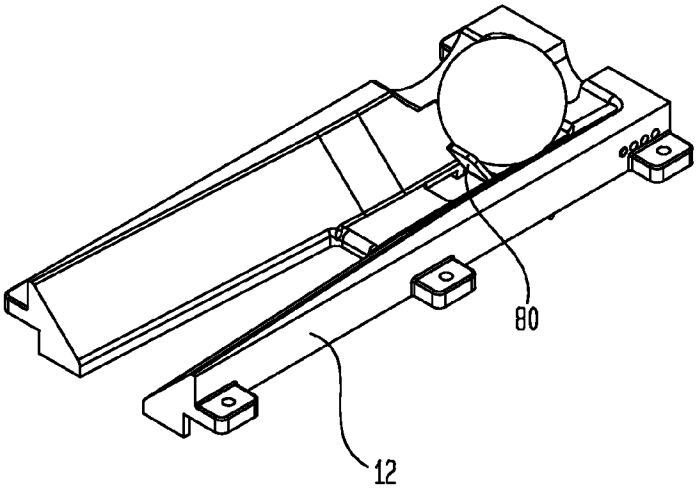
Figure 33:
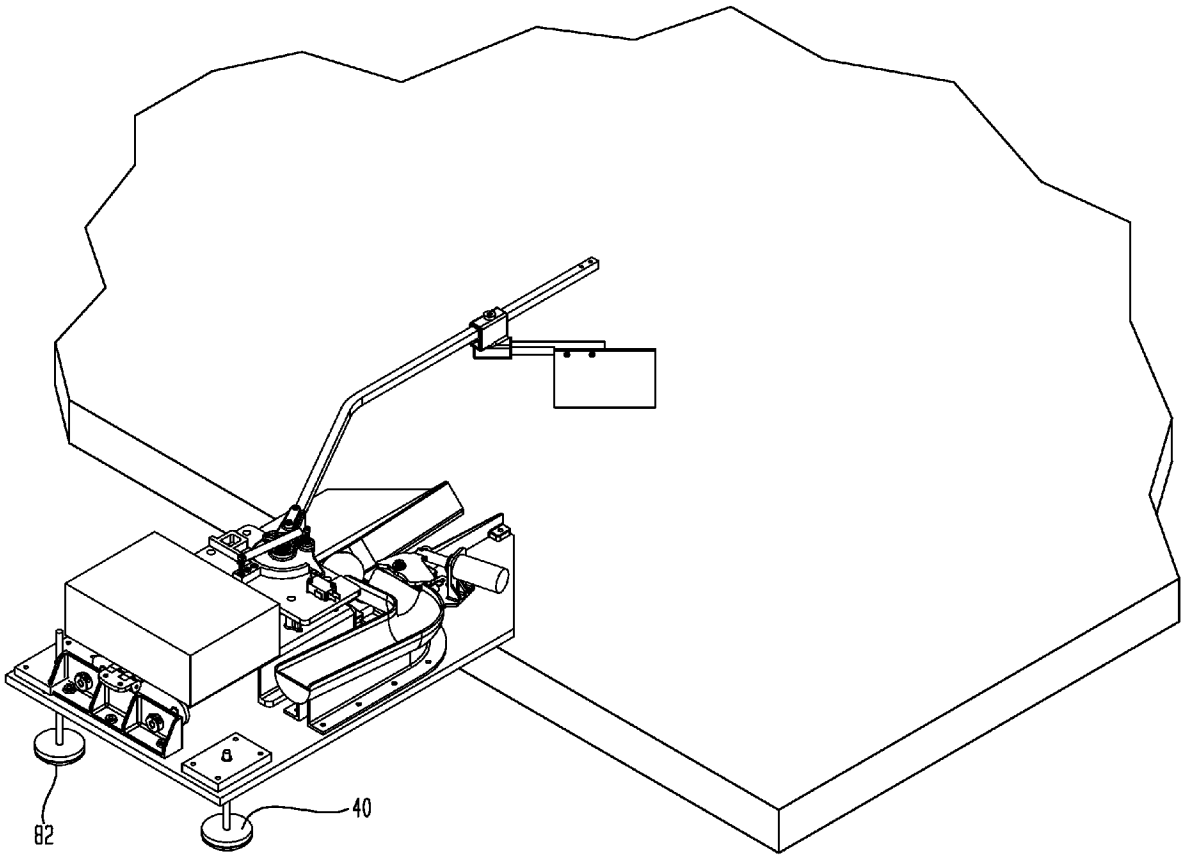
FIG. 33 illustrates two adjustable feet.

FIGS. 24, 25, 26, 27 and 28 illustrate the golf balls being transferred from the holding ramp 14 to the firing ramp 12. A flap 80 holds a golf ball in place on the ramp 12 until the firing solenoid 20 is fired. FIGS. 29 and 30 show further details of the relationship between the arm pivot 30, the spring 32, the arm pivot extension 34 and the snap switch 36. FIGS. 31 and 32 show further details of the ramp 12 and the flap 80. FIG. 33 illustrates the two adjustable feet 40 and 82. Note that although only two adjustable feet are shown, more can be used.

Figure 34:
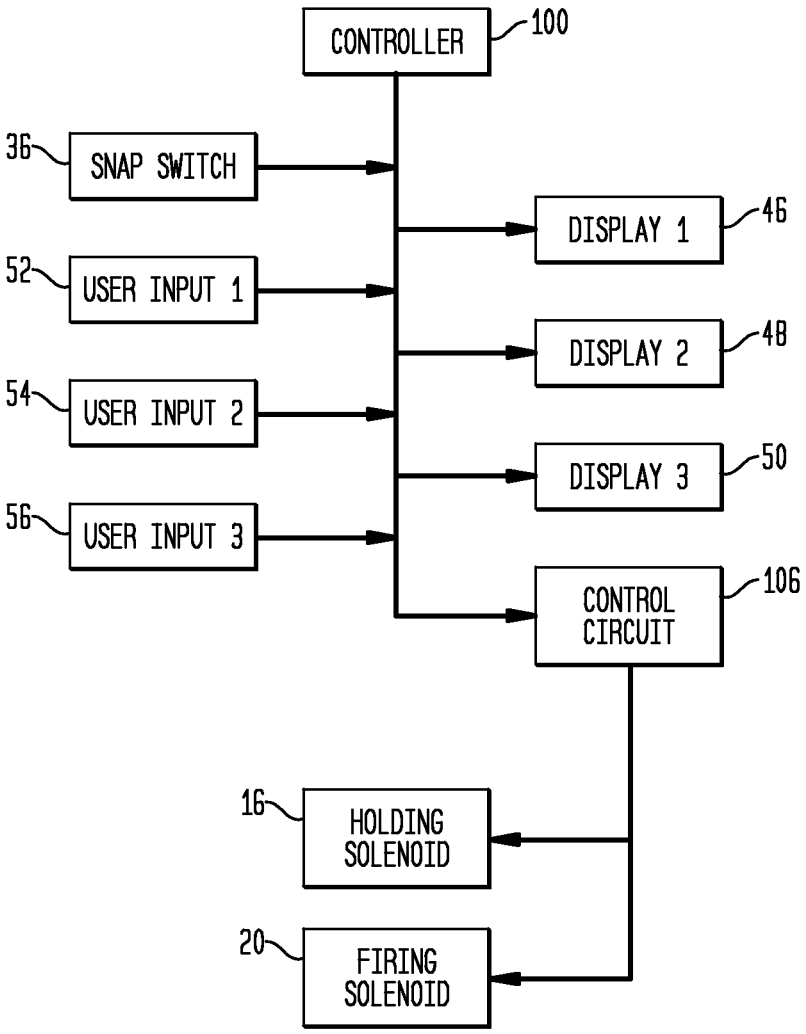
FIG. 34 illustrates an electrical block diagram of the further embodiment of the present invention.

FIG. 34 illustrates an electrical block diagram of the further embodiment of the present invention. A controller 100 is provided. This can be a microcontroller, a microprocessor or any other controller circuit. The snap switch 36 provides an input to the controller 100. User inputs 52, 54 and 56 also provide inputs to the controller 100. The user inputs 52, 54, and 56 can be a knob connected to a potentiometer that provides a selectable resistance to the controller 100 to allow a user to set preferences related primarily to the timing of the user's swing. (Additionally, the device can be equipped with a Bluetooth radio transmitter/receiver. The above selections can also be set with a Wireless Device and, such as a Smartphone, with an application that will communicate with the device. Displays 46, 48 and 50 are connected to the controller 100 and controlled by the controller 100 to display selected information. The controller 100 is also connected to the holding solenoid 15 and the firing solenoid 20 through a control circuit 106 to control the operation of these solenoids in a manner that will be explained.

Figure 35:
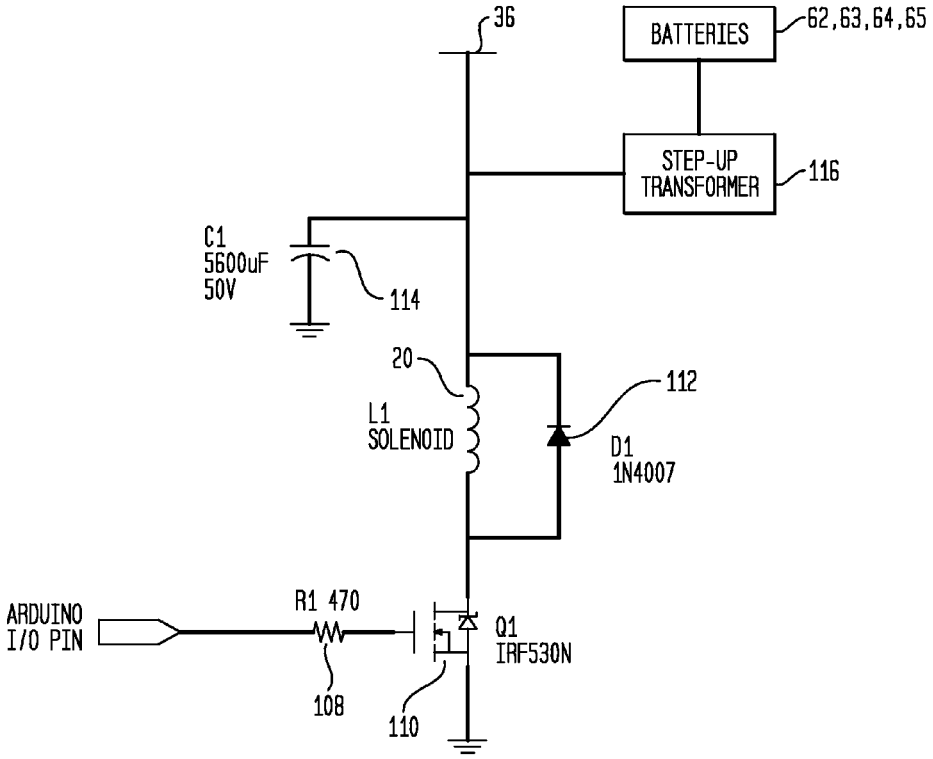
FIG. 35 illustrates a control circuit for a firing solenoid in accordance with an aspect of the present invention.

FIG. 35 illustrates a part of the control circuit 106. Specifically, the part of the control circuit that controls the firing solenoid 20 is illustrated. An output from the microcontroller 100 is connected to a resistor 108. The resistor 108 is connected to a MOSFET 110. The MOSFET can be a 1RF530N. The MOSFET 110 is connected to the firing solenoid 20, which has a diode 112 across its terminals. A capacitor 114 is connected to the firing solenoid 20. A step up transformer 116 steps up a voltage created by the batters 62 to 65, preferably to 36 volts, to charge the capacitor 114, which can then cause the solenoid to fire when triggered by the output from the controller 100 at the resistor 108.

The controller 100 runs two main program loops. One loop is for calibrating the unit. The other loop is for feeding golf balls to a user, and it begins as soon as the unit is calibrated.

The calibration starts when the unit is turned on or when the user depresses the button 56. In either of these cases, the controller 100 goes into the calibration required loop. The controller 100 causes the text "calibration required" to be displayed in the display 50. Ball power and total time are displayed in displays 46 and 18 and can be adjusted via the analog inputs 54 and 52, respectively. The inputs 52 and 54 can be potentiometers that are connected to the controller 100.

To start the calibration cycle, the gate switch 36 must be in the off position (gate closed) for calibration. This insures that the arm 24 is in the proper position. If the arm 14 is not properly positioned, then the switch 36 will be open, in which case, a press of the calibration button 56 will be ignored by the controller 100.

One embodiment of calibration also requires a 45 degree paddle to be in a specific location which is marked on the swing arm. In one embodiment, the paddle 26 is moved within the paddle holder 28 to properly position the paddle 26. In another embodiment, another paddle 27 can be positioned within the paddle holder 28. In either case, the paddle 26 or 27 should be adjacent the point at which the club head strikes the golf ball. This should be done correctly by the user because the unit has no way of verifying the paddle position. The user will input a preferred TOTAL TIME and a Preferred Ball Time. For example, if the user prefers to have a TOTAL TIME for his/her swing of 1.2 seconds, 1200 milliseconds will be inputted. Then, if the user prefers to have, for example, a 3 to 1 ratio proportion for his/her downswing in relation to the total time, the user will enter 300 milliseconds which is not only the downswing time, but also the amount of time the ball will be required to move from resting and projected to its arrival at the impact zone. The calibration will then be set to achieve a ball time 300 milliseconds. When the gate 36 is closed and the calibration button 56 is pressed, the controller 100 will count down a predetermined number, launch a ball, and record the ball's travel time from launch until it hits the paddle (ball time). This number can be determined by the controller 100 by determining the amount of time between the ball launch and the opening of the gate 36 when the ball hits the paddle 26 or 27. If the displayed ball time is greater than the preferred ball time, the user is required to lower the speed at which the solenoid fires the ball. Then the next calibration ball will be fired, if the ball time displayed is lower than the preferred ball time the user will be required to increase the speed at which the solenoid fires the ball. After several trial and error adjustments by the user, when the user sets inputs to where the required ball time equals the time inputted, the controller recognizes that the preferred time has been achieved and the controller will automatically exit calibration mode and the device is ready for use. In another embodiment, the controller will manage the trial and error process of adjusting the ball speeds, through interpolating the recorded ball times, until the preferred ball time is achieved. The purpose of this is for the convenience to the user of not needing to manually make the adjustments.

Different swing timings can be programmed into the calibration step, at the user's option. Each of these times can be separately input, so the user can select different swing times.

In operation, when the golfer begins his swing, the golf head contacts the paddle 26, which is positioned away from the impact point by the width of the golf head. When the back swing starts, the arm moves in a counterclockwise position. The spring 140 initially biases the arm 24 closed, but when the arm 24 starts moving, the spring 140 causes the arm to continue to rotate out of the way.

Figure 36:
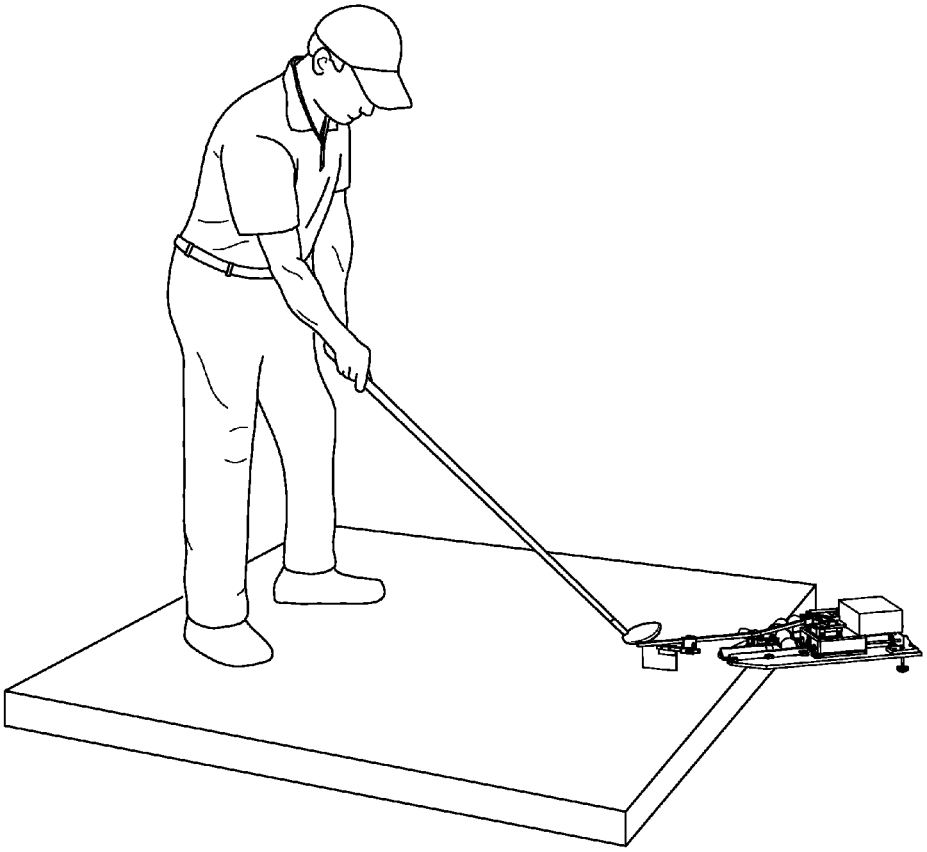
FIGS. 36, 37, 38, 39, 40 and 41 illustrate an embodiment of the golf training device in use.
Figure 37:
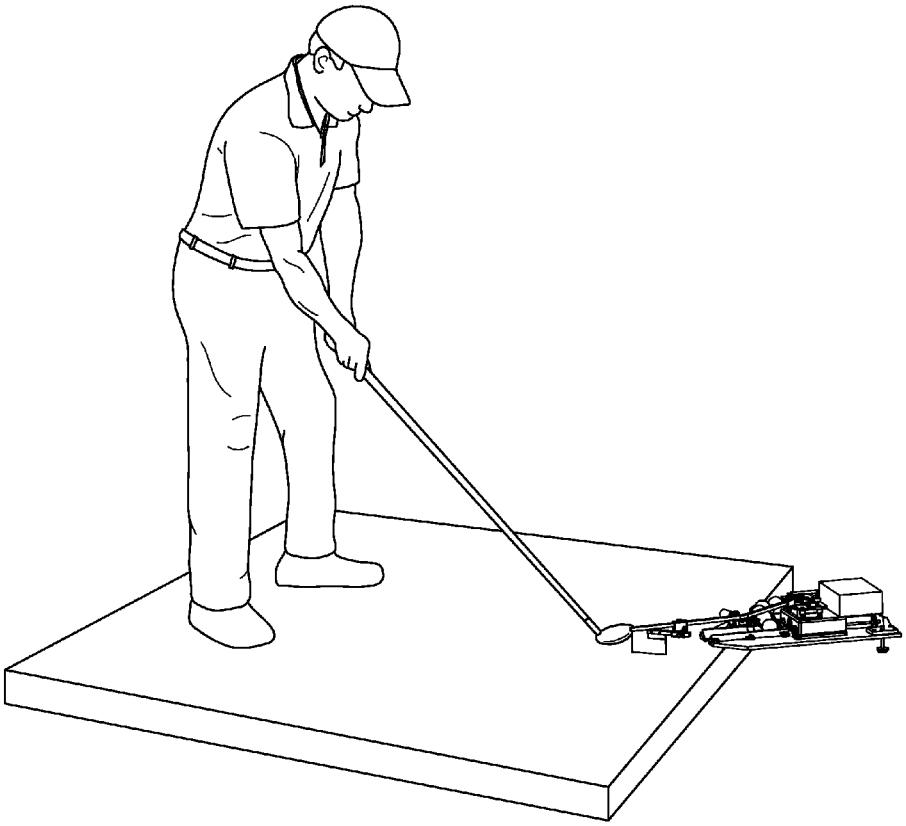
Figure 38:
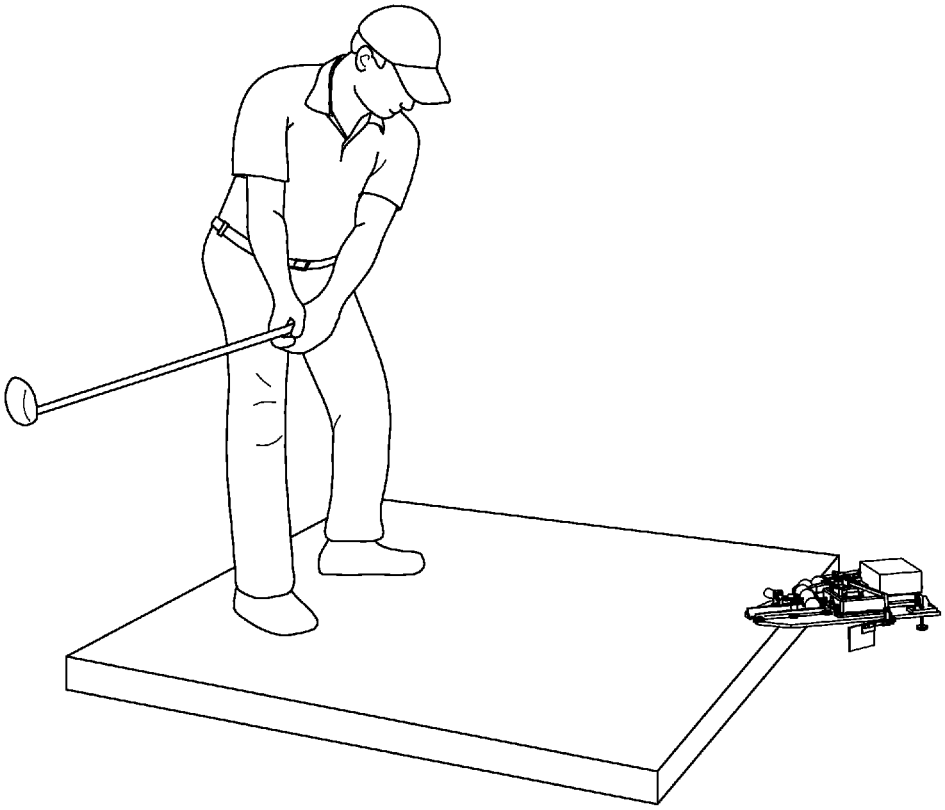
Figure 39:
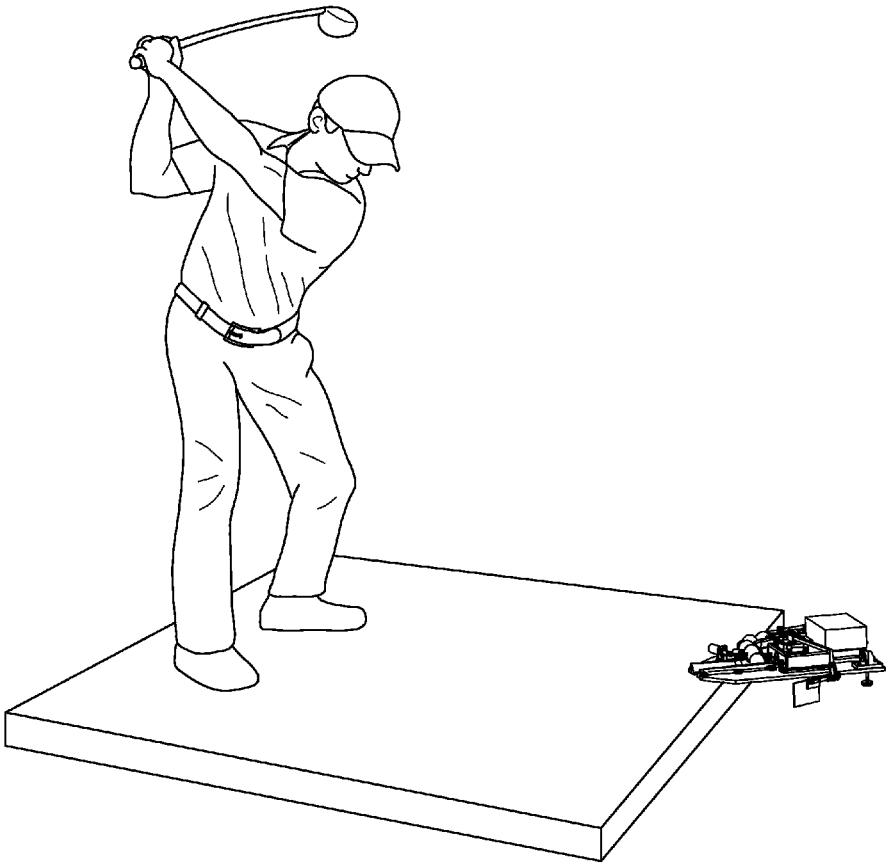
Figure 40:
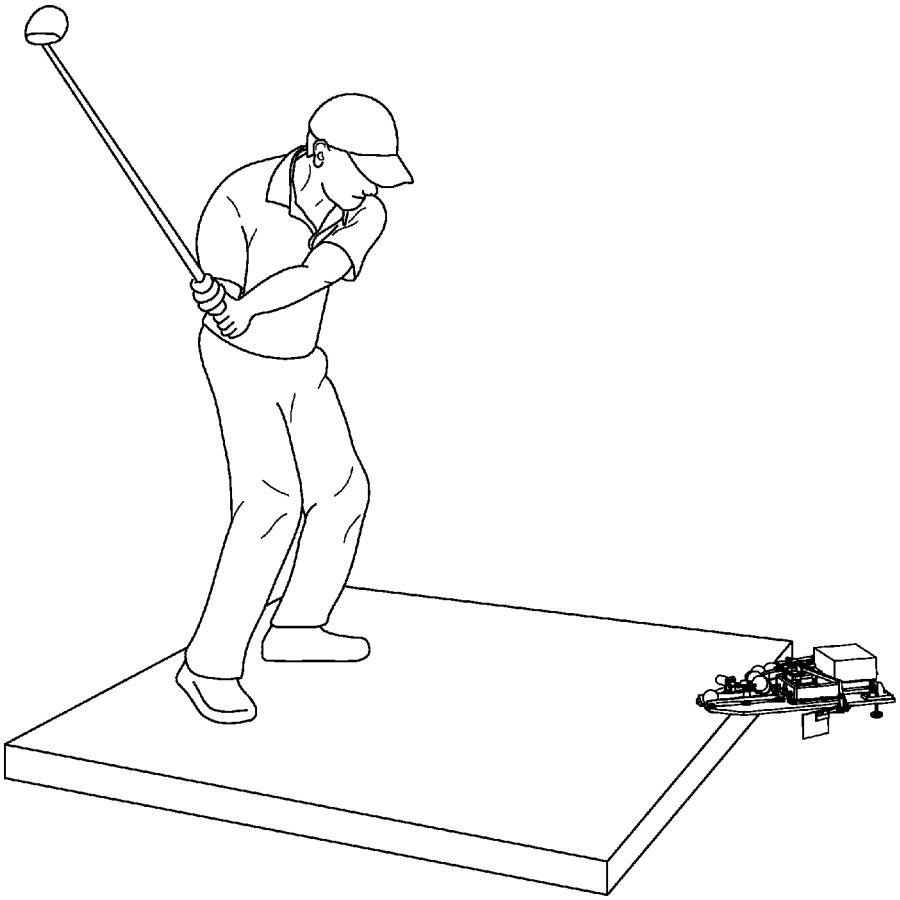
Figure 41:
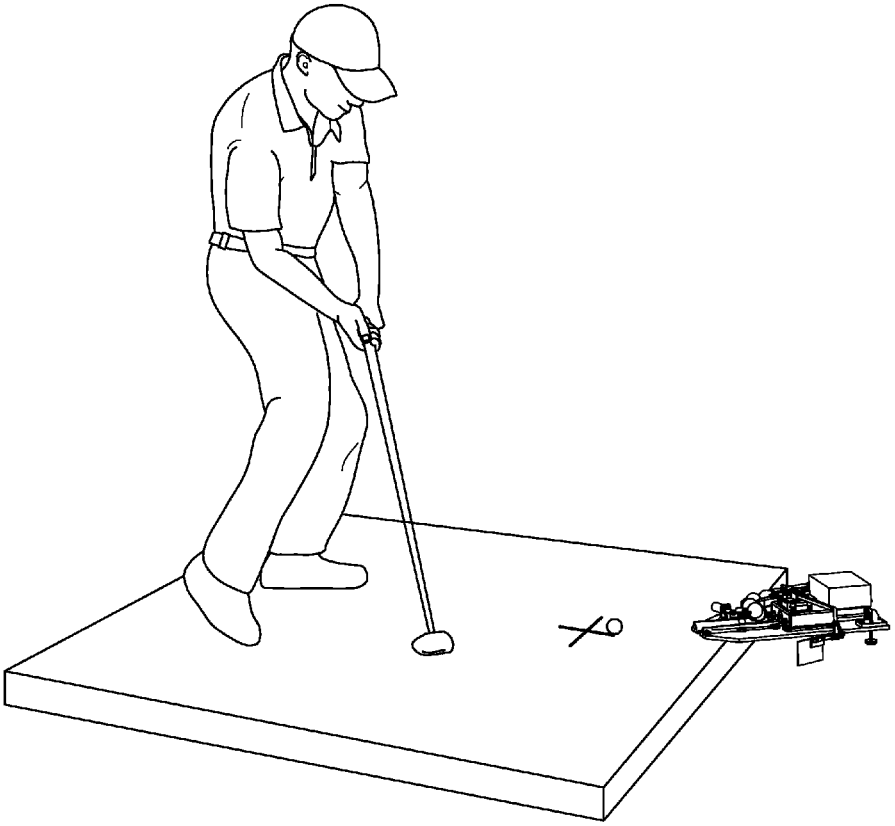

When the arm 24 rotates, the switch 36 opens. As shown in FIG. 36, the controller 100 monitors the position of the switch 36. When the controller 100 senses the switch 36 in the open position, the controller enters a delay period. The delay period, from the user's perspective is calculated by the controller by subtracting the Ball Time from the Total Time inputted by the user during calibration mode. Also, other compensations can be factored into the calculation of the Delay Period, unbeknownst to the user. For example, in this embodiment, a 50 millisecond second compensation for the solenoid coil magnetization lag (the time between when the solenoid is told to fire and when it actually begins to move the ball) and a 60 millisecond compensation for the time it takes on average for the user to move their clubhead during the takeaway from rest until the moment the clubhead strikes the paddle, are used. Of course if different solenoids were used, the compensation time would be different. Also the controller 100 allows for adjustments to be made by the user to manually increase or decrease the compensation for the initial takeaway time. Immediately following the delay period, The controller 100 sends a pulse to the control circuit 106, which is shown in FIGS. 35 and 36. The pulse from the controller 100 is applied to the resistor 108, as shown in FIG. 36. The resistor 108 closes the transistor switch 110. The closing of the transistor switch 110 causes current to flow through the firing solenoid and applies force the ball. 20. The current is provided from a charge stored in the capacitor 114. The capacitor 114 is preferably charged up to 36 to 40 volts. This can be accomplished by a step-up transformer 116 connected to a battery circuit 118.

The controller 100 controls the speed of the ball to the contact point by controlling the width of the pulse applied to the resistor 108. This is set to achieve the ball time specified by the user in the calibration steps.

When the solenoid 20 fires, it causes the solenoid housing 58 to move in a direction opposite the firing pin of the solenoid 20. The solenoid housing 58 moves along the rails 66 and 68. The movement is dampened by the springs 70 and 72. This structure assists in keeping the golf training device from moving a small amount everytime the solenoid 20 is fired and is important to maintain an accurate ball time.

Figure 26:
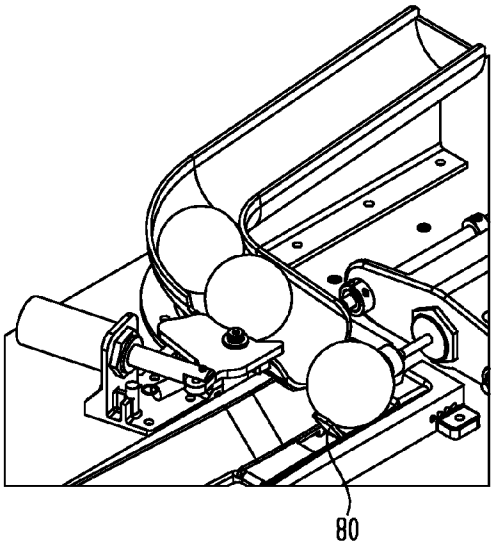
FIGS. 24, 25, 26, 27 and 28 illustrate the mechanical structure of a holding ramp and a firing ramp, as well as the transfer of golf balls from the holding ramp to the firing ramp.
Figure 25:
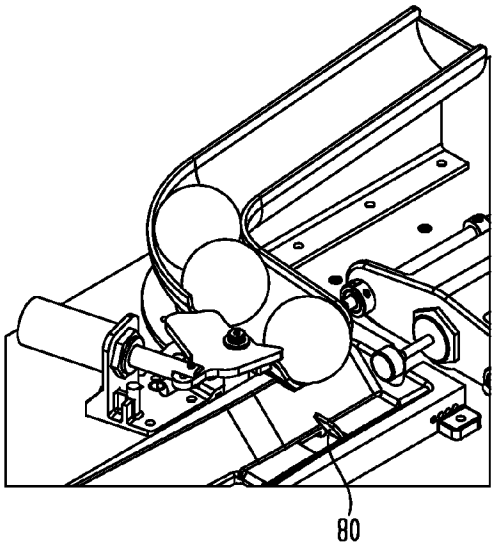
Figure 24:
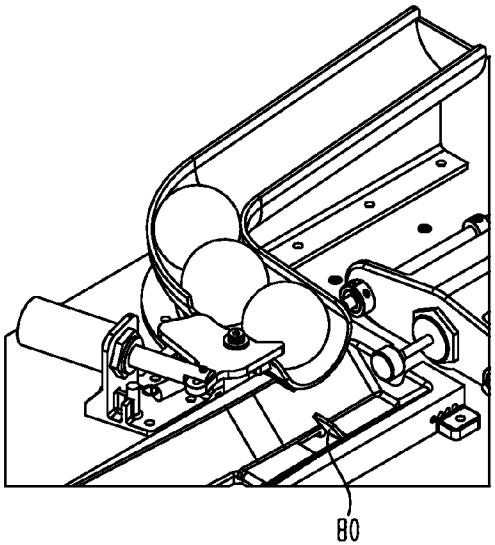
Figure 27:
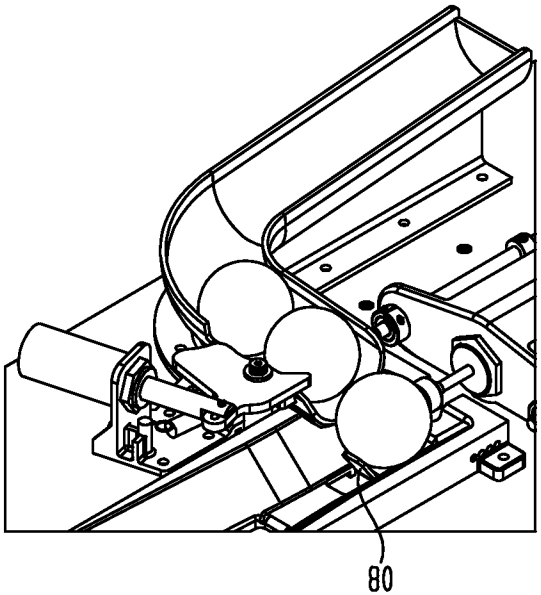

After the firing solenoid 20 is fired, the controller 100 sends a pulse to the holding solenoid 15 through the control circuit 106. The control circuit for the holding solenoid 15 is substantially the same as the control circuit shown in FIG. 35. Before the pulse from the controller 100 is applied to the holding solenoid 15, the holding solenoid holds a golf ball in position, as shown in FIG. 25. The pulse from the controller 100 to the holding solenoid 15 causes the holding solenoid 15 to move and releases a golf ball. Upon release, the golf ball moves from one pathway to the next. When the golf ball moves to its new pathway, it is held in place by a ramp 80 extending from the path way, as shown in FIGS. 24, 25 and 26. Meanwhile, the holding solenoid 15 closes and holds a new golf ball in place, as shown in FIGS. 27 and 28. When the firing solenoid 20 fires, the ball is pushed down the pathway past the ramp 80 and moves to the strike point.

The pathway that delivers the golf ball to the strike point and the ramp 80 are shown in greater detail in FIGS. 31 and 32. As can be seen, the pathway has an opening along its length. As the ball moves down the pathway, the size of the opening increases, gradually lowering the golf ball down the pathway, for a flush transition to the hitting surface FIGS. 36, 37, 38, 39, 40 and 41 illustrate the embodiment of the golf training device shown in FIGS. 20 to 35 in use. Note that in this case the golf training device propels a golf ball at a user at a different angle than ninety degrees. The golf training device can be set up to propel the golf ball at the golfer at angles other than ninety degrees or perpendicular to the path of the golf swing.

Various embodiments of the present invention provide a device which upon a triggering event, dispenses a ball through, in some cases, applied force to the ball, with the intention of moving the ball on a path from the point of projection to a predetermined location.

Various embodiments of the present invention provide a device which, in some cases, upon a triggering event, dispenses a ball and applies variable amounts force to the ball, with the intention of moving the ball on a straight path trajectory from the point of projection to a predetermined location within a predetermined amount of time.

Various embodiments of the present invention provide a device which, in some cases, upon a triggering event, enters predetermined delay period, then dispenses and applies force required to move the ball on a straight path trajectory from the point of projection to a predetermined location within a predetermined amount of time.

Various embodiments of the present invention provide a device which Upon a triggering event, dispenses and applies variable amounts force to a ball with the intention of moving the ball from its point of projection, on a straight path trajectory, to arrive at a predetermined location at a predetermined elapsed time from the moment of projection.

In accordance with some embodiments of the present invention, prior to use, the device calibrates itself to compensate for ball weight, friction, and other environmental influences that can affect the amount of time required to reach the predetermined location at the elapsed time desired. It can do this by test firing several balls for a desired elapsed time. A microprocessor interpolates the results and calculates the required level of force.

The device of the present invention, upon a triggering event, trains a golfer to intercept and strike a moving golf ball, projected into the Swingpath of the golfers' clubhead.

It also trains a golfer to intercept and strike a moving golf ball, projected into the "impact zone" within the Swingpath of the golfers' clubhead.

For golf training purposes, the predetermined location is the point where the trajectory of the moving ball intersects the target line the golfer has addressed.

In an embodiment of the device of the present invention, the device allows a user to intercept and strike a moving golf ball, projected following a pre-set time delay upon the action of the golfers' backswing.

It also trains a golfer to intercept and strike a moving golf ball within a specific amount of elapsed time.

It also trains a golfer to intercept and strike a moving golf ball within a specific amount of elapsed time (commencing the moment the swing is initiated and concluding the moment the ball reaches the impact zone).

It also trains a golfer to intercept and strike a moving golf ball within a specific amount of elapsed time (commencing the moment the swing is initiated, and concluding the moment the ball reaches the impact zone) with the elapsed time allotted set to the elapsed time measured between takeaway and impact during the swing of a highly skilled golfer.

It also trains a golfer to intercept and strike a moving golf ball within a specific amount of time (commencing the moment the swing is initiated and concluding the moment the ball reaches the impact zone) with the elapsed time allotted set to the elapsed time measured between takeaway and impact during the swing of a highly skilled golfer. Where the time from trigger to the moment prior to ball release is a multiple of the elapsed time from the moment of ball is propelled to the moment it arrives in impact zone.

In accordance with aspects of the present invention, a device trains a golfer to develop a swing with a desirable ratio of backswing to downswing. A noted optimal ratio is 3 to 1.

For the purposes of the Patent, the term "Rhythm" refers to the proportion in which the parts of the swing move to one another. Rhythm will represent the ratio of Backswing to Downswing. Example 3 to 1. The Backswing is 3 times the elapsed time as the downswing.

For the purposes of the Patent, "Consistent Rhythm" refers to maintaining this ratio on each swing.

For example of how the device works in one embodiment, if 3 to 1 ratio is selected (for example), then the user selects a desired Ball to Impact Zone Period which is the Elapsed Time (displayed in milliseconds) measured from the moment the ball is projected to the moment it arrives at the impact zone. Upon initiation of the backswing, the device is triggered. Upon trigger, the device calculates and enters a delay period equal to 3× the selected Ball to Impact Zone Period (also referred to a simply as "ball time" earlier Immediately following the delay period, the ball is projected towards the impact zone and arrives at the impact zone (for interception by the golfers swinging clubhead) at precisely the elapsed time selected for the Ball to Impact Zone Period. The moment the ball is projected, is the INDICATION/SIGNAL to the user to initiate his downswing. The solenoid, by the nature of its composition, has a very distinct sound when it projects the ball. This sound, inadvertently, can also be utilized by the golfer as cue to initiate the downswing. As the golfer develops his ability to reach the top of his backswing at a pace sufficient to provide the remaining time needed to initiate his downswing (when the ball is projected), and deliver his clubhead to the impact zone to intercept the moving golf ball, he will, efficiently and accurately, be practicing the 3 to 1 rhythm, the tempo by way of the inputted times and Timing, by striking the ball at a precise location (where the ball is only available there to strike, for microseconds. With further practice, he will develop the ability to execute these skills in a manner that propels the moving ball towards a target on a similar to trajectory as when striking a stationary ball. With even further practice, he should develop the ability to propel a stationary ball utilizing the coordination and motor skills developed while practicing with the moving ball. With even further practice he should develop the ability to propel a stationary ball, with consistent Rhythm, Tempo and Timing, utilizing the coordination and motor skills developed while practicing with the moving ball.

For the purposes of the Patent, the term "Tempo" will represent the pace of the swing within a particular rhythm. For example, one golfer may have a backswing of 0.75 Seconds and a downswing of 0.25 seconds and another golfer may have a backswing of 0.9 seconds and a downswing of 0.3 seconds. Although the second swing had a longer elapsed time, the ratio of backswing to downswing in both swings are the same, 3 to 1. Both of these swings have the same Rhythm, but they have different Tempos.

For the purposes of the Patent, "Consistent Tempo" refers to executing this Tempo for each swing which the tempo is desired.

For the purposes of the Patent, the term "Timing" refers to one's ability to direct the peak level of amplified energy created in the clubhead, to a specific location at a specific moment in the golf swing.

For the purposes of the Patent, "Consistent Timing" refers to executing this action on each swing.

A golfer may have consistent rhythm, but utilize different tempos for different shots.

A hard punch seven iron vs a full swing 7 iron. A golfer may utilize different tempos to execute these swings while maintaining consistent rhythm. The punch (with a shorter backswing) may have a 0.6 second backswing time and a 0.2 second downswing time. Where the full swing seven iron may have a 0.9 second backswing and a 0.3 second downswing. Both swings still have the rhythm of 3 to 1, yet they execute a different tempo within the rhythm.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention.

I claim:

1. Apparatus for using a plurality of golf balls to train a person to swing a golf club, comprising:

a pathway that conveys the plurality of golf balls, one at a time, from a first end of an imaginary line to a second end of the imaginary line;

a holder that contains the plurality of golf balls, the holder connected to the pathway and arranged near the first end of the imaginary line to selectively roll one of the plurality of golf balls at a time along the imaginary line from the first end to the second end, the holder further having an input;

a trigger connected to the input of the holder that senses the golf swing and causes the input of the holder to roll one of the plurality of golf balls along the imaginary line;

wherein the golf ball is rolled across a predetermined location on the imaginary line where the golf ball is struck by the golf club, the golf ball rolling across the predetermined location at a specific elapsed time after the trigger senses the golf swing.

2. The apparatus of claim 1, wherein the trigger is a mechanical arm having one end connected to the input of the holder.

3. The apparatus of claim 2, wherein the mechanical arm has a second end which is hit by the golf club during the golf swing to trigger the holder to release one of the plurality of golf balls.

4. The apparatus of claim 3, wherein the mechanical arm has an adjustable length.

5. The apparatus of claim 1, wherein the trigger is an optical sensor.

6. The apparatus of claim 5, wherein the optical sensor senses the golf club during the golf swing, and when the optical sensor senses the golf club, it sends an electrical signal to the input of the holder to cause one of the plurality of golf balls to be released.

7. The apparatus of claim 1, further comprising a sound generator connected to the trigger, wherein the sound generator generates a sound a predetermined time after the trigger is triggered.

8. The apparatus of claim 7, wherein the predetermined time is selectable.

9. A method of using a plurality of golf balls to train a person to swing a golf club, comprising:

the person starting a golf swing;

detecting the golf swing with a trigger device the trigger device, in response to detecting the golf swing, communicating with a container that holds the plurality of golf balls;

the container, in response to the trigger device communicating with the container, rolling one of the plurality of golf balls along an imaginary line;

wherein the golf ball is rolled across a predetermined location on the imaginary line where the golf ball is struck by the golf club, the golf ball rolling across the predetermined location at a specific elapsed time after the trigger senses the golf swing.

10. The method of claim 9, wherein the trigger device is a mechanical arm that communicates with the container mechanically.

11. The method of claim 9, wherein the trigger device communicates with the container electrically.

12. The method of claim 11, wherein the trigger device is an optical sensor.

13. The method of claim 9, comprising the trigger device, in response to detecting the golf swing, communicating with a sound generator to cause the sound generator to generate a sound a predetermined time after the trigger device detects the golf swing.

14. The method of claim 13, comprising adjusting the predetermined time.

15. The apparatus of claim 7, wherein the time the sound is generated is simultaneous with the start of the downswing of the golf club.

16. The method of claim 13, wherein the time the sound is generated is simultaneous with the start of the downswing of the golf club.

17. The apparatus of claim 1, further comprising a firing solenoid with a plunger connected to the pathway, the trigger sending a signal to the firing solenoid to cause the plunger to extend out to propel the golf ball from the pathway along the imaginary line.

18. The apparatus of claim 1, further comprising a controller and a user interface, the controller receiving a signal from the trigger to propel the golf ball, and the user interface connected to the controller whereby the specific elapsed time is selected, the controller determining a period of the firing signal to control the specific elapsed time.

19. The apparatus of claim 17, wherein the speed at which the solenoid propels the ball is automatically adjusted to allow the ball to roll across the predetermined location at the specific elapsed time when the ball is rolled across different surfaces.

20. The apparatus of claim 17, wherein the speed at which the solenoid propels the ball is manually adjusted by the person to allow the ball to roll across a preferred predetermined location at a preferred specific elapsed time.

* * * * *